US010403484B2

(12) United States Patent
Bayat et al.

(10) Patent No.: US 10,403,484 B2
(45) Date of Patent: Sep. 3, 2019

(54) OPTICAL MODULATION OF ON-CHIP THERMIONIC EMISSION USING RESONANT CAVITY COUPLED ELECTRON EMITTERS

(71) Applicant: UNIVERSITY OF SOUTHERN CALIFORNIA, Los Angeles, CA (US)

(72) Inventors: Fatemeh Rezaeifar Bayat, Los Angeles, CA (US); Rehan Rashid Kapadia, Los Angeles, CA (US)

(73) Assignee: University of Southern California, Los Angeles, CA (US)

( * ) Notice: Subject to any disclaimer, the term of this patent is extended or adjusted under 35 U.S.C. 154(b) by 0 days.

(21) Appl. No.: 15/956,300

(22) Filed: Apr. 18, 2018

(65) Prior Publication Data

US 2018/0301324 A1 Oct. 18, 2018

Related U.S. Application Data

(60) Provisional application No. 62/486,581, filed on Apr. 18, 2017.

(51) Int. Cl.
*H01J 40/06* (2006.01)
*H01J 3/02* (2006.01)

(52) U.S. Cl.
CPC ..... *H01J 40/06* (2013.01); *H01J 3/021* (2013.01)

(58) Field of Classification Search
CPC . H01J 40/06; H01J 40/00; H01J 3/021; H01L 31/00; H01L 31/04; H02S 10/30
See application file for complete search history.

(56) References Cited

U.S. PATENT DOCUMENTS

2008/0001139 A1* 1/2008 Augusto ..... H01L 27/14603 257/13
2016/0001398 A1* 1/2016 Kancharla ..... B23K 26/0665 65/112
2018/0131311 A1* 5/2018 Karalis ..... H01L 31/04

* cited by examiner

*Primary Examiner* — Anne M Hines
(74) *Attorney, Agent, or Firm* — Brooks Kushman P.C.

(57) ABSTRACT

A photonic electron emission device includes an emitter, a photonic energy conduit evanescently coupled to the emitter, and an anode. The emitter includes a component selected from the group consisting of a metal, a semimetal, a semiconductor having a bandgap that is less than about 3.5 eV. The anode is positively biased with respect to the emitter, the anode directing electrons emitted from the emitter.

21 Claims, 26 Drawing Sheets

OPTICAL MODULATION OF ON-CHIP THERMIONIC EMISSION USING RESONANT CAVITY COUPLED ELECTRON EMITTERS

CROSS-REFERENCE TO RELATED APPLICATIONS

This application claims the benefit of U.S. provisional application Ser. No. 62/486,581 filed Apr. 18, 2017, the disclosure of which is hereby incorporated in its entirety by reference herein.

STATEMENT REGARDING FEDERALLY SPONSORED

RESEARCH OR DEVELOPMENT

The invention was made with Government support under Contract No. FA9550-16-1-0306 awarded by the Air Force Office of Scientific Research. The Government has certain rights to the invention.

TECHNICAL FIELD

In at least one aspect, the present invention is related to electron emission devices that can be fabricated on a single chip.

BACKGROUND

Photon assisted electron emission from solids have been investigated extensively since early 1960. Specially with the advances of Q-switched and Ti-Sapphire ultrafast laser sources, the vast majority of researches devoted to demonstrating sharp electron beam via exploring the electron emission from various metallic surface or sharp tip emitter exposed to high power picosecond laser radiation. Ultrafast electron source is essential for many applications such as free electron laser source, vacuum electronic high-power THz generation and ultrafast electron microscopy. Up to date, intensity dependence of the photon assisted electron emission as well as energy distribution and emittance of the emitted electrons were at the top interests of the published papers. Despite all developments achieved in more than 50 years after the initial results on photon assisted electron emission, this phenomenon suffers from low quantum efficiency as the biggest challenge for being used in wide range of the abovementioned applications. The recent value of the reported QE for Cu used as photocathode in RF photo-gun is around $1e^{-5}$ and it hardly exceeds slightly over $1e^{-4}$ only under deep UV (at 250-300 nm) illumination.

Realization of on-chip, low-power, high-speed, spatially addressable electron emission arrays would be potentially transformative for a variety of civilian and military applications, including but not limited to, electron microscopy, electron beam lithography, space propulsion, high power microwave (HPM) devices, free electron lasers, displays, and ultrafast electron diffraction. While electrically-gated field emission devices have been heavily explored in the past, the large capacitances due to the close proximity of a control gate often limits the maximum modulation frequency of these devices. Optical modulation of emission offers the highest modulation speeds as well as a variety of emission mechanisms such as single photon photoemission, multiphoton emission, and thermionic emission. However, in general, optical approaches rely on free-space coupling of an optical beam onto electron emitters, a process that is highly inefficient, particularly when utilizing nanostructured tips. Furthermore, free-space coupling to nanostructures places stringent requirements on incident laser alignment, and is not practical if nanoscale alignment between incident photons and arrays of millions of emission tips is required.

Accordingly, there is a need for improved methods for generating electron emission currents.

SUMMARY

In at least one aspect, a photonic electron emission device includes an emitter, a photonic energy conduit evanescently coupled to the emitter, and an anode. The emitter includes a component selected from the group consisting of a metal, a semimetal, a semiconductor having a bandgap that is less than about 3.5 eV. The anode is positively biased with respect to the emitter, the anode directing electrons emitted from the emitter.

In another aspect, microscale optical cavities coupled to thermionic emitters that enable a class of efficient and ultrafast optically-modulated, on-chip, thermionic electron emitters are provided. This class of devices is referred to as Optical Cavity Thermionic Emitters (OCTET). The devices include a microfabricated optical cavity, such as Fabry-Perot or ring resonator, and a heterostructured thermionic emitter with a small bandgap or metallic thermionic emitter (e.g. LaB6) deposited on a wider bandgap electrical and thermal conductor (e.g. doped Si). By tuning the resonant wavelength of the optical cavity, one can ensure photons are efficiently and selectively absorbed by the small bandgap/metallic emitter, enabling design of GHz-THz regime on-chip electron emission sources. The disclosure discloses elucidating the properties of single cavity-single emitter OCTETs, but may be applied to more complex cavity-tip structures. First, the disclosure discloses design rules based on the cavity optical properties and emitter optical and thermal properties. Next, detailed device simulations are carried out using optical and thermal 3-D numerical simulations that accurately account for both geometry as well as temperature and wavelength dependent materials properties. The disclosure illustrates that devices with highly-efficient photon to thermal conversion efficiencies >60% can be achieved despite small emitter active absorption volumes <0.01 $\mu m^3$ and moderate Q optical cavities. Critically, OCTETs may be designed with ultra-fast sub-ns thermal response time, and sub 10 ps current response times, or efficient steady state excitation—with <5.4 μW of power required to achieve nA level current emission per tip. Due to the recent advances in integrated photonics and electronics, the structures explored here may be fabricated using standard microfabrication techniques.

In still another aspect, optical cavities are provided as a means to enable nanoscale control over the spatial interaction between the photon electric field and nanostructured electron emission tips.

BRIEF DESCRIPTION OF THE DRAWINGS

FIGS. 14A and 14B 5: (A) Free Space Illuminated Emission Device, (B) Integrated waveguide assisted Emission Device.

DETAILED DESCRIPTION

Reference will now be made in detail to presently preferred compositions, embodiments and methods of the present invention which constitute the best modes of practicing the invention presently known to the inventors. The Figures are not necessarily to scale. However, it is to be understood that the disclosed embodiments are merely exemplary of the invention that may be embodied in various and alternative forms. Therefore, specific details disclosed herein are not to be interpreted as limiting, but merely as a representative basis for any aspect of the invention and/or as a representative basis for teaching one skilled in the art to variously employ the present invention.

Except in the examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: the first definition of an acronym or other abbreviation applies to all subsequent uses herein of the same abbreviation and applies mutatis mutandis to normal grammatical variations of the initially defined abbreviation; and, unless expressly stated to the contrary, measurement of a property is determined by the same technique as previously or later referenced for the same property.

It is also to be understood that this invention is not limited to the specific embodiments and methods described below, as specific components and/or conditions may, of course, vary. Furthermore, the terminology used herein is used only for the purpose of describing particular embodiments of the present invention and is not intended to be limiting in any way.

It must also be noted that, as used in the specification and the appended claims, the singular form "a," "an," and "the" comprise plural referents unless the context clearly indicates otherwise. For example, reference to a component in the singular is intended to comprise a plurality of components.

Throughout this application, where publications are referenced, the disclosures of these publications in their entireties are hereby incorporated by reference into this application to more fully describe the state of the art to which this invention pertains.

Abbreviations:

"OCTET" means Optical Cavity Thermionic Emitter.

"SEM" means scanning electron microscopy.

"SOI" means silicon-on-insulator.

"TE" means transverse electric.

"TM" means transverse magnetic.

Definitions

"Work function" means the minimum quantity of energy required to remove an electron to infinity from a surface of a solid. In the context of the present invention, this solid can be a metal, semimetal, or a semiconductor.

"Emission active material" means any material that can liberate electrons into a vacuum or gas upon thermal excitation, photon excitation, or a combination thereof.

Figure 1A:
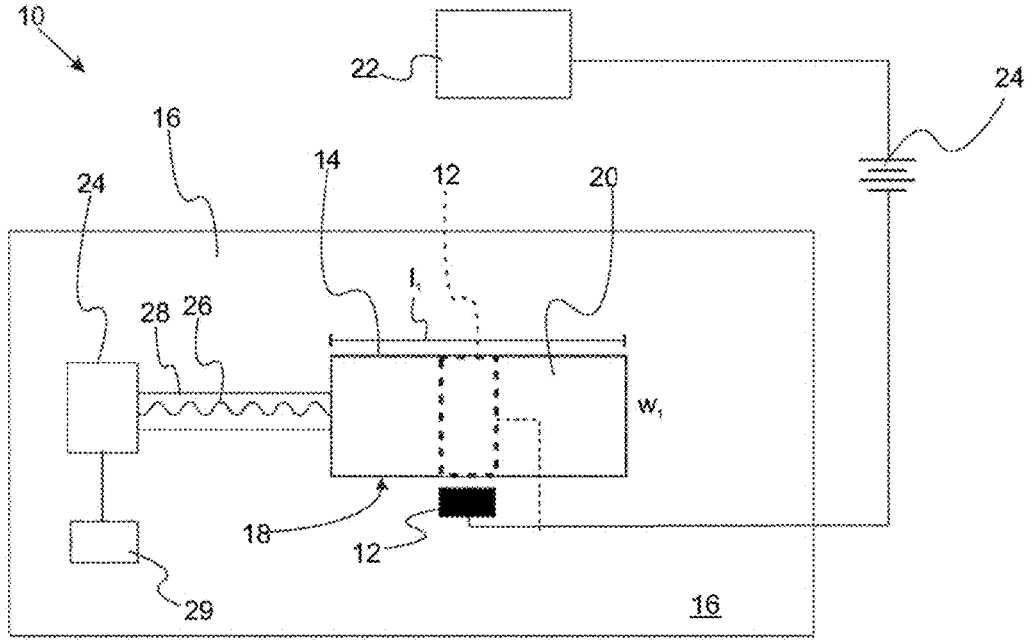
FIGS. 1A and 1B: (A) Top view of a photonic electron emission device, and (B) side view of a photonic electron emission device.
Figure 1B:
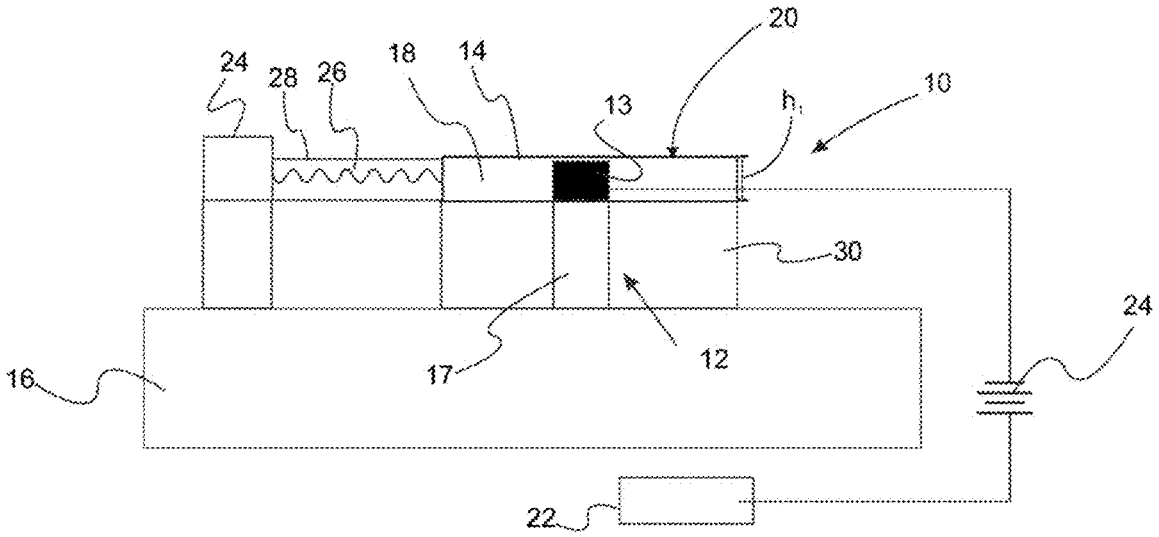

With reference to FIGS. 1A and 1B, a schematic illustration of a system having a photonic electron emission device is provided. Photonic electron emission device 10 includes emitter 12 which includes an emission active material 13 that can emit electrons (i.e., an electron emission current)

from a surface upon sufficient energy excitation. Typically, electrons are emitted into a vacuum or into a gas (e.g. an inert gas). Characteristically, the emission active material includes an emission component selected from the group consisting of a metal, a semimetal, a semiconductor having a bandgap that is less than about 3.5 eV. Photonic energy conduit 14 is evanescently coupled to the emitter. Characteristically, the emitter emits an electron emission current induced by photonic energy received from the photonic energy conduit and absorbed by emission active material 13. Photonic energy conduit 14 is disposed over substrate 16 with emitter 12 being sufficiently close to surface 18 of photonic energy conduit 14 allow evanescent coupling. Typically, the distance from emitter 12 to surface 18 is from about 0 to 100 nm. In a refinement, the distance from emitter 12 to surface 18 is from about 5 to 50 nm. In a refinement, emitter 12 is disposed over substrate 16 and is adjacent to photonic energy conduit 14. In a variation, includes a protrusion 17 having a top surface 19 over which emission active material 13 is positioned. In an alternative refinement depicted by dashed line, emitter 12 is disposed over and optionally contacts surface 20 of photonic energy conduit 14. Typically, the distance from emitter 12 to surface 20 is from about 0 to 100 nm. In a refinement, the distance from emitter 12 to surface 20 is from about 5 to 50 nm. Anode 22 is positively biased with respect to the emitter 12 via power supply 24. Characteristically, anode 22 directs and/or optionally accelerates electrons emitted from the emitter 12. In a refinement, anode 22 is positively biased with respect to the emitter 12 with a voltage from 1 V to 100,000 V. Photonic energy conduit 14 receives electromagnetic radiation from photon energy source 24 (e.g., a laser, LED, etc.) through a waveguide or fiberoptic 28. Typically, electromagnetic radiation 26 provided by photon energy source 24 has a wavelength from about 138 nm (i.e., 9 eV) to about 4000 nm or more. In one refinement, electromagnetic radiation 26 provided by photon energy source 24 has a wavelength from about 300 nm to about 700 nm. In another refinement, electromagnetic radiation 26 provided by photon energy source 24 has a wavelength from about 700 nm to about 2000 nm. In a variation, photonic electron emission device 10 includes a modulator 29 that modulates the electromagnetic radiation. photonic electron emission device 10 can have a response time in the GHz to THz range. Therefore, in a refinement, the electromagnetic radiation can be modulated from 0 up to about 10 THZ. In a further refinement, the electromagnetic radiation can be modulated from 1 MHZ to 10 THZ.

Although the present embodiment is not limited by any particular dimensions of the photonic energy conduit, typically the length $l_1$ of conduit 14 is from about 100 nm to 30 microns, width $w_1$ is from about 50 nm to 15 microns, and height $h_1$ from about 1 nm to 10 microns. Moreover, photonic energy conduit can be a waveguide, resonator, optical cavity, or a combination thereof. Specific examples of resonators include Fabry-Perot resonator and ring resonators.

Photonic energy conduit 14 include an evanescent field-supporting surface (e.g., surface 18 and/or 20) over which an evanescent field develops and/or can be maintained. The surface can be a surface of a waveguide, optical cavity, or a resonator. The formation of the electron emission current can be by photoemission, photo-assisted field emission, thermionic emission, or a combination thereof. Photoemission will dominate when the photon energies from photon energy source is greater than the work function for the emitter. Photo-assisted field emission will occur and dominate when the photon energy is less than but within about 20 percent of the work function of emitter 12. Thermionic emission will dominate when the photon energy is less than about 20 percent of the work function of emitter 12. Examples of the emission active material lanthanum hexaboride ($LaB_6$), cerium hexaboride ($CeB_6$), graphene, gallium arsenide, gallium nitride, tungsten, and combinations thereof. The dominant electron emission mechanism depends of the specific work function of the specific emission active material and the photon energy ($E_{ph}$). Table 1 provides several useful combinations of these properties.

TABLE 1

Examples and properties of the Emission active material

| Material | Workfunction | Photoemission | Photo-assisted Field Emission | Thermionic Emission |
|---|---|---|---|---|
| $LaB_6$ | 2.7 eV | $E_{ph} > 2.7$ eV | 2.7 eV $> E_{ph} > 0.55$ eV | 0.55 eV $> E_{ph}$ |
| Graphene | 4.5 eV | $E_{ph} > 4.5$ eV | 4.5 eV $> E_{ph} > 0.9$ eV | 0.9 eV $> E_{ph}$ |
| n-Si | 4.1 eV | $E_{ph} > 4.1$ eV | 4.1 eV $> E_{ph} > 0.82$ eV | 0.82 eV $> E_{ph}$ |

The transfer of energy (e.g., electromagnetic radiation) from photonic energy conduit 14 to emitter 12 can depend on the mode for the electromagnetic radiation within the photonic energy conduit. For a waveguide or resonator, the modes can be expressed as $TM_{nm}$ or $TE_{nm}$, wherein n, m are independently 0, 1, 2, 3, 4 . . . 10. Higher modes can transfer energy over smaller spatial dimensions than lower modes.

As depicted in FIGS. 1A and 1B, photonic electron emission device 10 is disposed over substrate 16 which can be a semiconductor wafer such as a silicon wafer, glass, metal, or any other suitable material. FIG. 1B illustrates a variation in which a dielectric layer 30 (e.g., standard silicon-on-insulator) is interposed between photonic energy conduit 14 and substrate 16. Advantageous, emitter 12, photonic energy conduit 14, photon energy source 24, and waveguide or fiberoptic 28 can all be fabricated in an on-chip process resulting in the integration of all of these components on a single chip (e.g., wafer). In a variation, photonic energy conduit 14, photon energy source 24, and waveguide or fiberoptic 28 can be fabricated in an on-chip process resulting in the integration these components on a single chip. In a variation, emitter 12 and photonic energy conduit 14 can be fabricated in an on-chip process resulting in the integration these components on a single chip.

Figure 2:
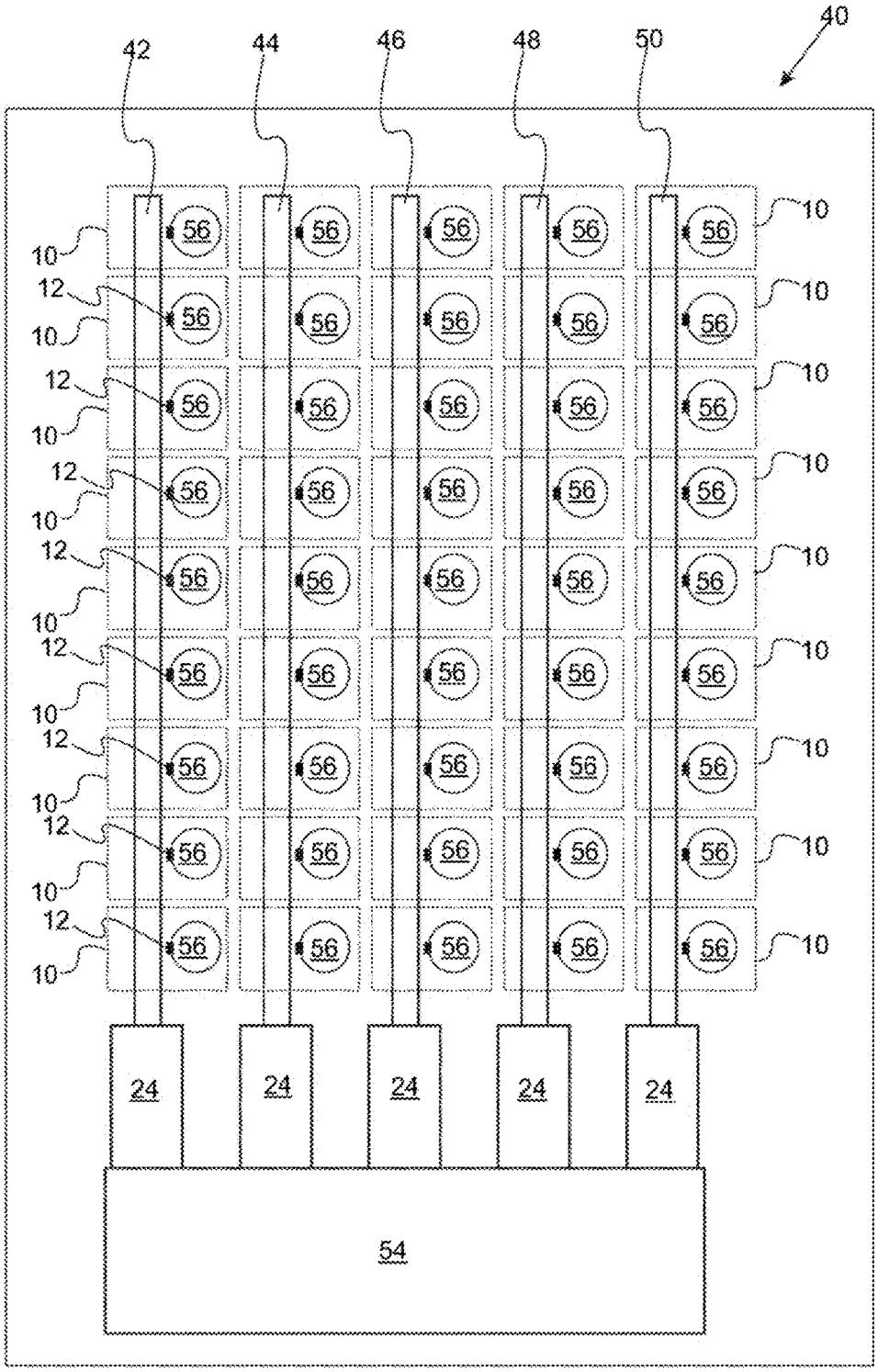
FIG. 2. Top view of a device having an array of photonic emission devices.

With reference to FIG. 2, a schematic illustration of an array of integrated electron emitters is provided. Integrated assay device 40 includes a plurality of photonic electron emission devices 10 which are of the design set forth herein and in particular, the design of FIGS. 1A and 1B. In this variation, the emitters of several devices are position proximate to each of waveguides 42-50 which functions as the photonic energy conduit 14 of FIGS. 1A and 1B. In this variation, photon energy source 24 can be a laser or light emitting diodes. Control electronics 54 may be integrated on the chip to modulate photon sources. In the example depicted in FIG. 2, the photons are guided using waveguides 42-50, and coupled to optical cavities 56 with integrated electron emitters 12. The electron emission patterns can be controlled by modulating the photon sources. Advantageously, this variation can be utilized to create multi-electron beam systems for large area electron sources.

With reference to FIGS. 3A-D, schematics of an optical cavity thermionic emitter ("OCTET") device platform that enables microscale thermionic emitters to be efficiently modulated by an optical signal is provided. In this variation, OCTET device 70 includes an optical cavity, an in particular, a resonant optical cavity for the photonic energy conduit described above. For example, OCTET device 70 includes optical cavity 72 which is evanescently coupled to a heterostructured emitter 74. The heterostructured emitter 74 includes the emitter includes a protrusion 76 having a top surface 77 over which emission active material 79 is positioned. The protrusion 76 aligns the emission active material with the photonic energy conduit (e.g., optical cavity 72). Typically, the face of the emission active material faces optical cavity 72 and has an area approximately equal to or less than the area of the opposing surface of optical cavity 72. In a refinement, protrusion 76 is a silicon 'fin' 76 with a layer of emission active material on the top surface of the fin. As set forth above, the emission active material includes an emission component selected from the group consisting of a metal, a semimetal, a semiconductor having a bandgap that is less than about 3.5 eV. A specific example of the emission action material is $LaB_6$. In this variation, the emission active material serves as the photon absorber and thermionic emitter, while the Si fin serves as the thermal and electrical contact in addition to physically supporting the emission active material at a predetermined height that aligns with optical cavity 72 at a position that allows evanescent coupling as set forth above. In a refinement, the silicon fin has a top surface with the emission active material (e.g. a $LaB_6$ layer) disposed adjacent to the top surface of the silicon fin. In one refinement, optical cavity 72 is a Fabry-Perot optical cavity that includes rectangular waveguide section 78 with Bragg reflectors 80, 82. It should be appreciated that the general design rules and constraints for this variation remain the same regardless of cavity structure or emitter composition details. To understand the device behavior, this disclosure discloses simple. The structure of FIG. 3A-D can be fabricated from a standard silicon-on-insulator (SOI) wafer as set forth above. In this regard, optical cavity 72 is disposed over silicon substrate 86. A silicon oxide layer 88 is interposed between silicon substrate 86 and optical cavity 72. Advantageously, the OCTET device platform provides device designers with two categories of devices: (i) highly efficient optically driven devices in the dc-MHz frequency ranges enabled by minimizing the emitter thermal conductivity, and (ii) ultra-fast optically modulated devices in the GHz-THz range enabled by maximizing the emitter thermal conductivity.

Figure 4:
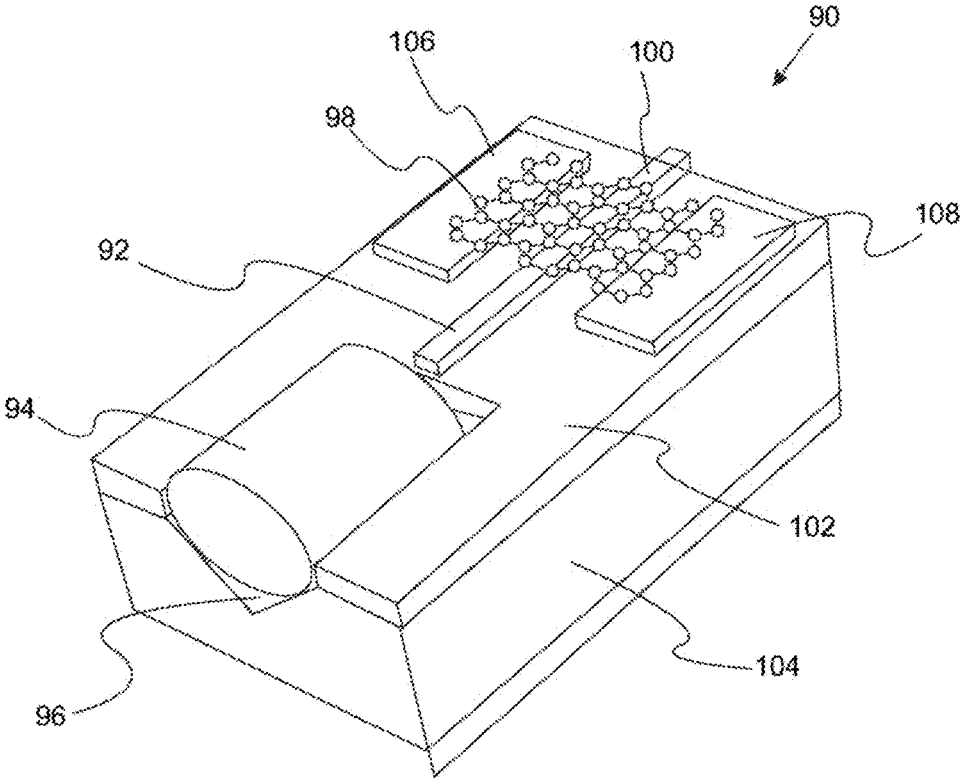
FIG. 4. Perspective view of a photonic electron emission device having an integrated waveguide.

With reference to FIG. 4, a schematic illustration of a photonic electron emission device having an integrated waveguide and an emitter overlaying the waveguide is provided. Photonic electron emission device 90 includes waveguide 92 which received electromagnetic radiation from fiberoptic 94 which is positioned in groove 96. In this variation, emitter 98 is positioned over surface 100 of waveguide 92. In a refinement, emitter 98 contacts surface 100. As set forth above, emitter 98 includes an emission active material includes an emission component selected from the group consisting of a metal, a semimetal, a semiconductor having a bandgap that is less than about 3.5 eV. A graphene layer is a particularly useful example of an emission active material for this variation. In a refinement, the graphene layer has a thickness form about 0.1 mm to about 10 mm. The structure of FIG. 4 can be fabricated from a standard silicon-on-insulator (SOI) wafer as set forth above. In this regard, waveguide 92 is disposed over cladding layer 102 (e.g., silicon oxide) which is deposited onto silicon substrate 104. In a refinement, metal contacts 106, 108 are disposed over cladding layer 102 and silicon substrate 104. Metal contacts 106, 108 are in contact with opposing edges of emitter 98 thereby allowing diagnostic measurements to be performed.

Advantageously, the photonic electron emission devices set forth herein can be used in a number of application. For example, the electron emission devices can be used in electron microscopes (i.e. scanning electron microscopes and transmission electron microscopes.) The electron emission devices can replace the thermionic or field emission gun to provide an electron beam with lower energy dispersion, enabling higher resolution. The photonic electron emission devices can also be used in vacuum electron devices (e.g. travelling wave tubes, gyrotrons etc.) Advantageously, the photonic electron emission devices can produce chopped electron beams at the frequency of amplification. In other application, the photonic electron emission devices can be used in electron beam lithography. In this application, the photonic electron emission devices can be a single chip that produces multiple beams to enable large area writing). In still other application, the photonic electron emission devices can be used in free electron lasers where the photonic electron emission devices can produce very low transverse energy dispersion beams beyond the capacity of current systems.

The following examples illustrate the various embodiments of the present invention. Those skilled in the art will recognize many variations that are within the spirit of the present invention and scope of the claims.

I. OCTET Analytical Models for the Optical, Thermal, and Current Characteristics.

To determine the steady state and time dependent optical response of the OCTETs here, certain device parameters must be known: $R_b$, the cavity mirror reflectivity; $A_s$, the single pass absorption of cavity photons into the emitter; and $\alpha_L$, the intrinsic and scattering loss in the cavity. For simplicity, one can assume that the $\alpha_L$ losses are negligible. The total fraction of photons injected into the cavity absorbed by the emitter, $A_T$, and the lifetime of cavity photons, $\tau_P$. can be defined. Assuming the cavity has two identical Bragg mirrors, the following expression for $A_T$ can be written:

$$A_T = \frac{A_s}{1-(1-A_s)R_b} \tag{1}$$

Figure 5A:
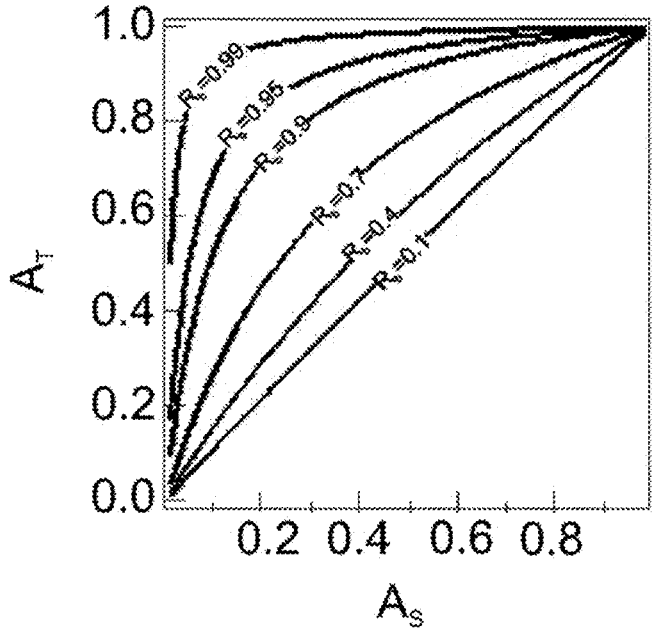
FIGS. 5A, 5B, 5C, and 5D: (A) Total photon absorption in emitter, $A_T$, as a function of single pass emitter absorption, $A_S$, for multiple cavity mirror reflectivities, $R_b$. (B) Cavity photon lifetime a function of $A_S$ for varied $R_b$. (C) $LaB_6$ emitter temperature as a function of power injected into the optical cavity as a function of Si fin thermal conductivity in W/m-K. (D) Spectral properties of Bragg mirror.

As shown in equation (1), the total absorbed power is the ratio of the single pass photon absorption in the emitter to the total photon loss per single trip. Thus, total absorption can be optimized by either maximizing mirror reflectivity ($R_b \rightarrow 1$), or maximizing the single pass absorption of the emitter ($A_s \rightarrow 1$). FIG. 5A shows the relationship between total absorption $A_T$ and single pass absorption $A_S$ for increasing $R_b$. Critically, even emitters with small single pass absorption $A_S$ can exhibit near 100% total absorption by increasing the cavity mirror reflectivity. However, increasing $R_b$, comes at the cost of the cavity photon lifetime, potentially limiting the ultimate modulation frequency of the OCTET.

Figure 5B:
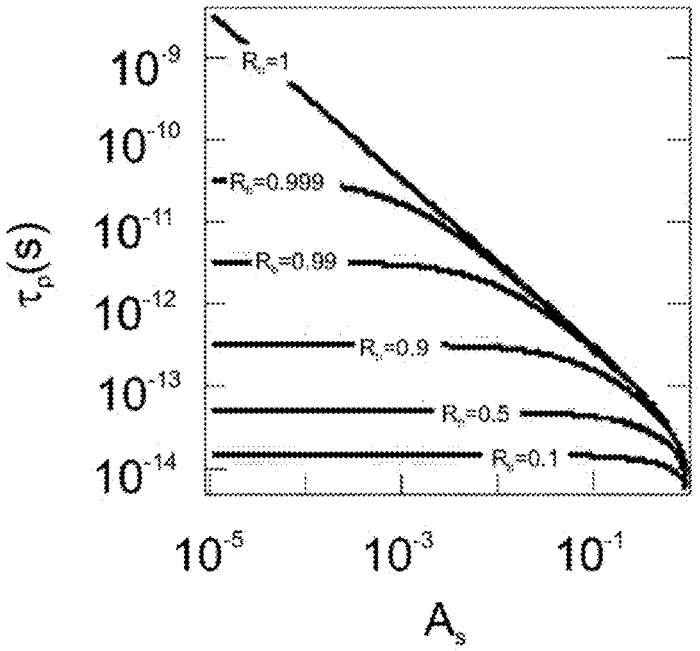

Using optical cavity lasing condition and considering rate of change in photon number inside cavity, Eq. (2) can be derived for the structure that shows the relationship between the cavity photon lifetime and the device parameters Equation 2 shows the relationship between the cavity photon lifetime and the device parameters, ignoring $\alpha_L$:

$$\frac{1}{\tau_P} = \frac{v_g}{L}\left(\log\frac{1}{R_b} + \log\frac{1}{1-A_s}\right), \tag{2}$$

where $v_g$ is the group velocity of the mode and L is the cavity length. The photon lifetime can then be plotted as a function of $A_S$ for different $R_b$ values, as shown in FIG. 5B. Importantly, it is observed that, in general, the photon lifetime in the cavity will be limited by the mirror loss to values less than 10 ps, indicating that the factor controlling the overall time response of the OCTET will be the thermal response.

Figure 5C:
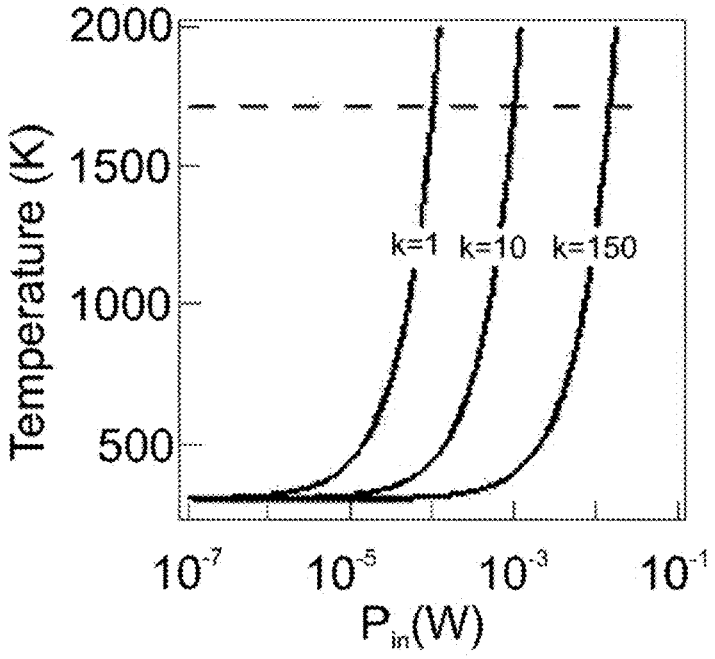
Figure 5D:
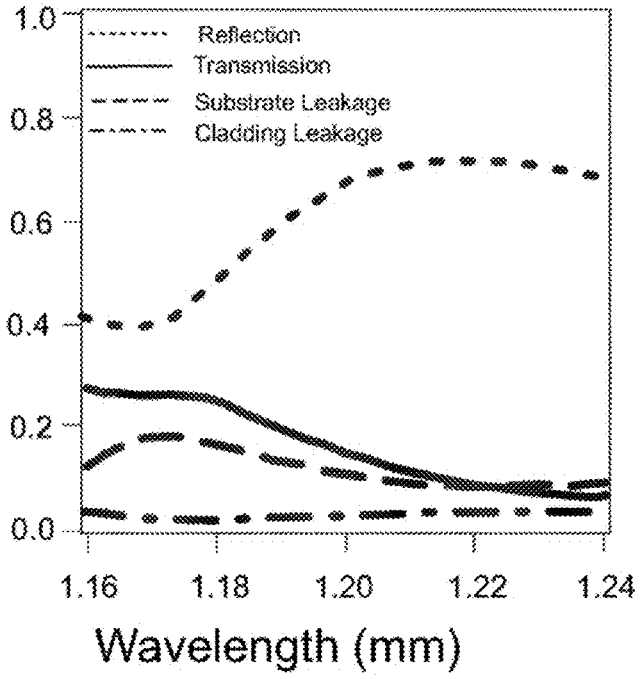

To determine the thermal and current response, the Richardson-Dushman equation is used in conjunction with a lumped thermal circuit model for both steady-state and cooling transient responses. To convert the absorbed photon flux to a thermal flux, it is assumed that electrons are in equilibrium with the lattice, which is reasonable for steady state behavior, as well as the transient behavior explored here due to the fast carrier relaxation time, which are typically on the subpicosecond timescale, as compared to the thermal relaxation time here, which are greater than 10 ps. The thermal and current responses are determined by the thermal mass, thermal conductivity, and work function of the emitters. The steady state model of the system can be written by assuming the dominant source of heat loss from the $LaB_6$ emitter is conduction through the Si fin. The steady-state DT of the $LaB_6$ emitter ca be written as:

$$\Delta T = \frac{P_{Abs}L}{kA} \tag{3}$$

where $P_{Abs}$ is the optical power absorbed by the $LaB_6$, k is the thermal conductivity of the Si fin, A is the area of the fin in the plane of the substrate, and L is the length of the fin from the $LaB_6$ to the substrate. The cooling transient response of the emitter can be written as $$T(t)=(T_m-T_b)e^{-t/\tau_{TH}}+T_b \tag{4}$$

where Tm is the initial maximum temperature of the emitter, $T_b$ is the bulk temperature, and $\tau_{Th}$=mCp/$k_{em}A_{em}$, where m is the mass, $C_p$ is the heat capacity, and $k_{em}A_{em}$ is the thermal conductance of the emitter. This can be rewritten as $\tau_{Th}=\rho_{em}C_pd_{em}/k_{em}A_{em}$, where $\rho_{em}$ is density of the emitter material, and $d_{em}$ is the emitter thickness, illustrating the critical role of emitter thickness in modulation speed of the device. The current density can then be estimated using the Richardson-Dushman equation $$J = AT^2\exp\left(-\frac{e\varphi_0}{k_bT}\right) \tag{5}$$

with Ab=29 A/cm$^2$K$^2$, A is Richardson constant, b is material factor for LaB6, and $\varphi_0$=2.7 eV for $LaB_6$. In the simulation section, the current density is used on all the emitting surface to calculate the total emitted current from the emitter. In FIG. 5C, the steady state temperature response is plotted versus absorbed power for emitters with cross sectional areas of $7\times10^{-2}$ μm$^2$ and Si fin height of 1 μm for three different fin thermal conductivities. From these results three general design rules can be stated: (1) For practical electron emitter designs, the cavity properties may be tuned to enable near unity photon absorption efficiency; (2) Efficient steady state devices require using an emitter with the smallest thermal conductance possible and are not limited by the $LaB_6$ thermal mass; and (3) For ultrafast devices, both small absorber thicknesses and high emitter thermal conductance are required.

Figure 3A:
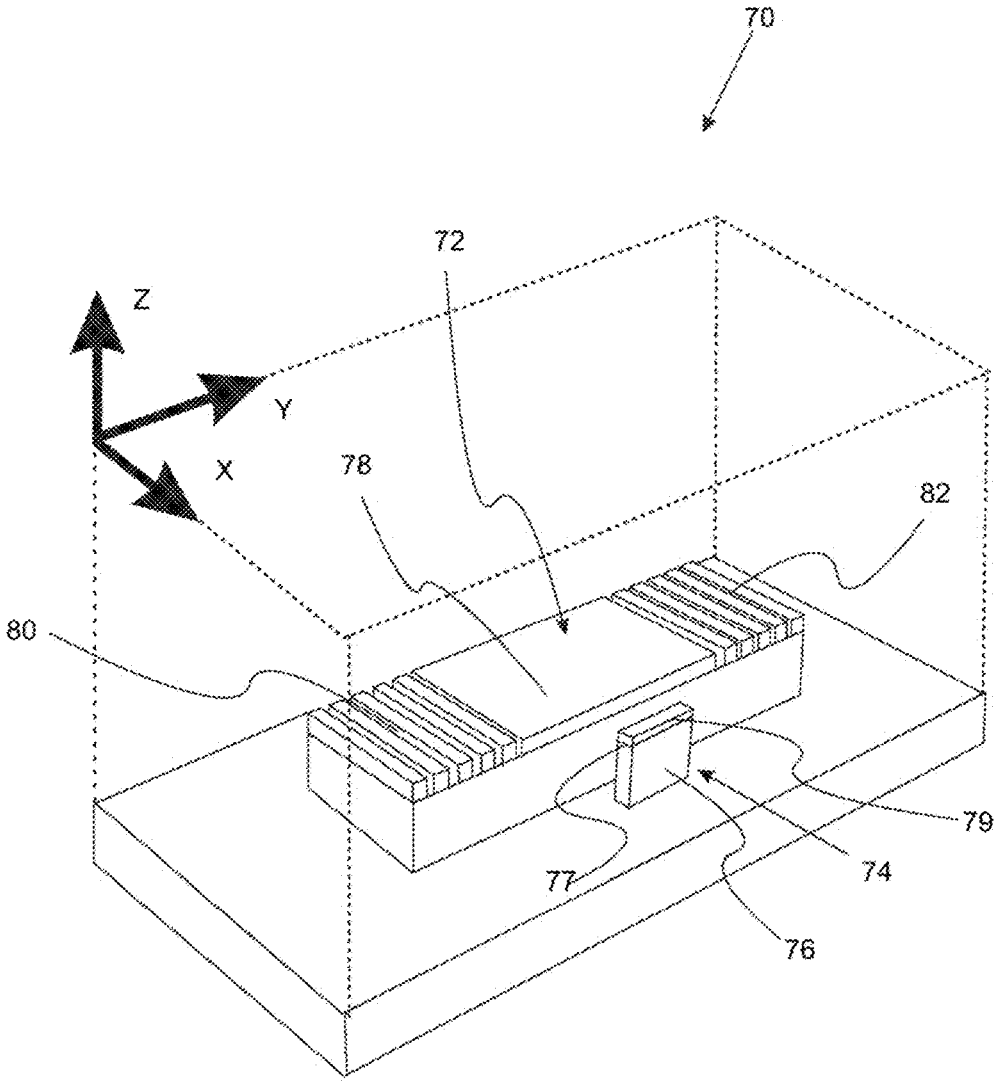
FIGS. 3A, 3B, 3C and 3D: (A) 3-D schematic view of OCTET device, (B) plan view of OCTET device, (C) cross-sectional view of OCTET; and (D) end view of OCTET.
Figure 3B:
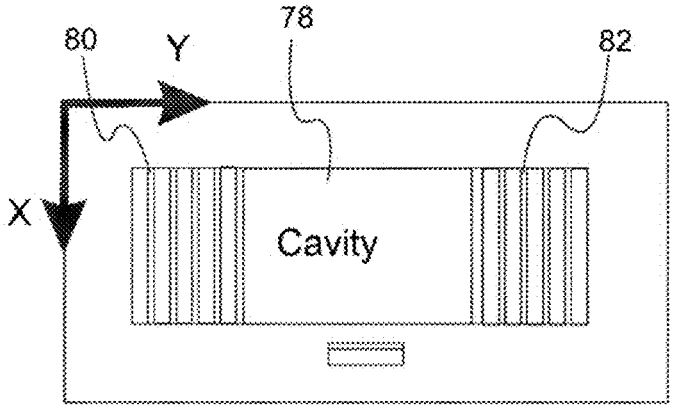
Figure 3C:
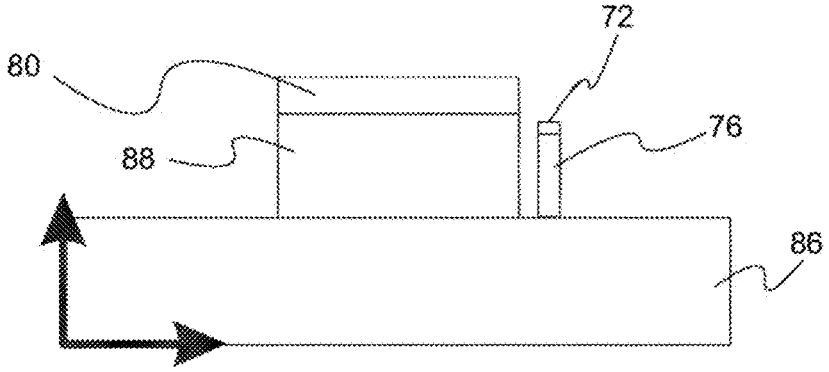
Figure 3D:
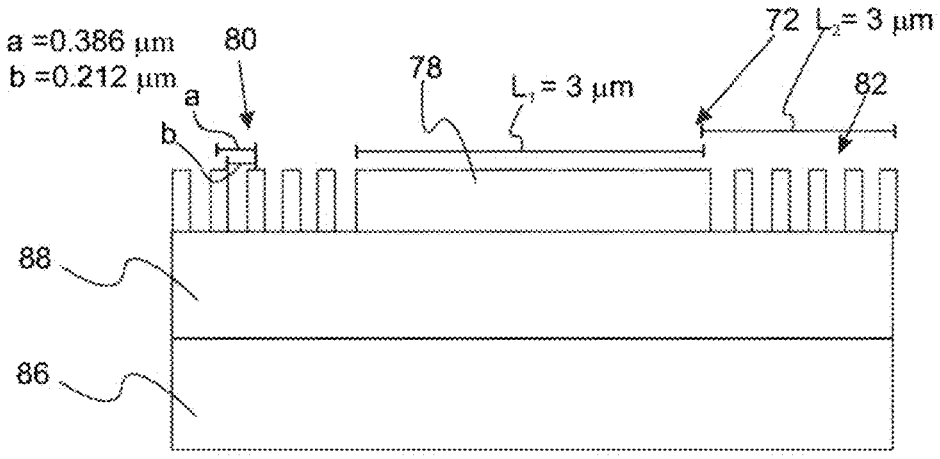
Figure 6A:
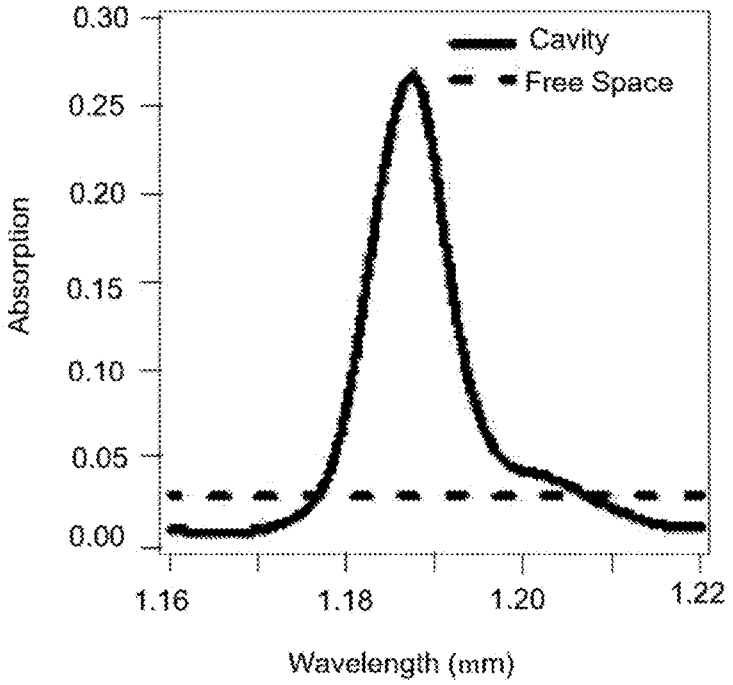
FIGS. 6A, 6B, 6C, 6D, and 6E: (A) Absorption spectrum of the emitter. (B) Electric field vs. time inside the cavity illustrating photon lifetime inside cavity. (C) Cross-sectional view of the photon electric field profile in the optical cavity-emitter system. (D) Top view of the photon electric field profile in the optical cavity-emitter system. (E) Top view of absorbed power in the emitter due to photons injected into the optical cavity.
Figure 6B:
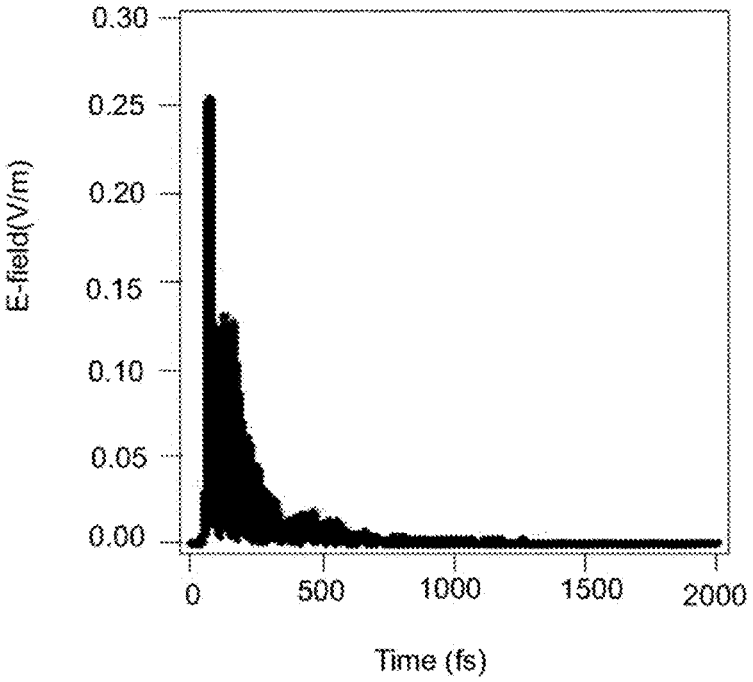
Figure 6C:
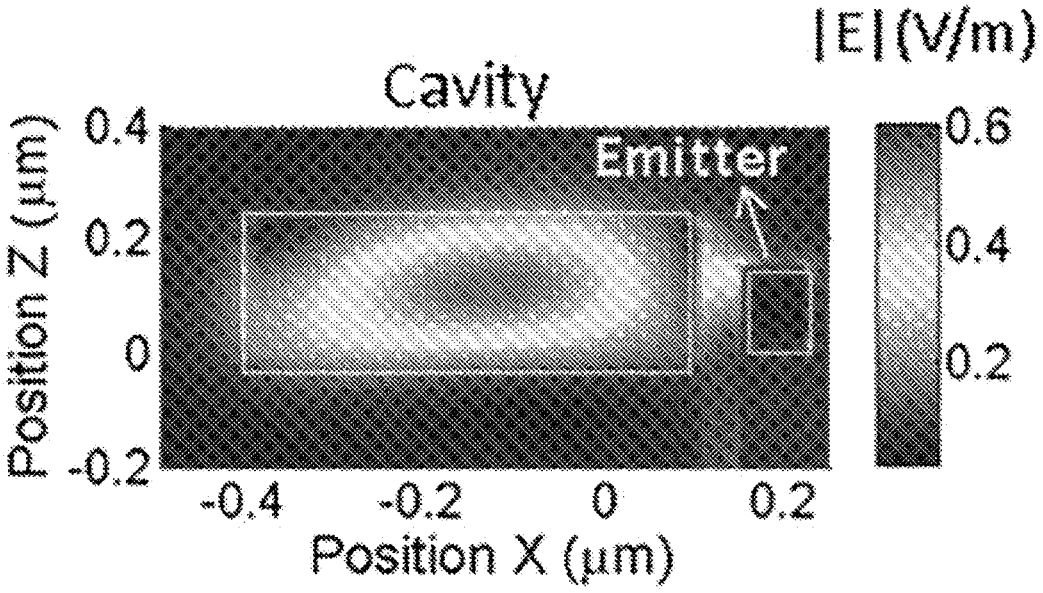
Figure 6D:
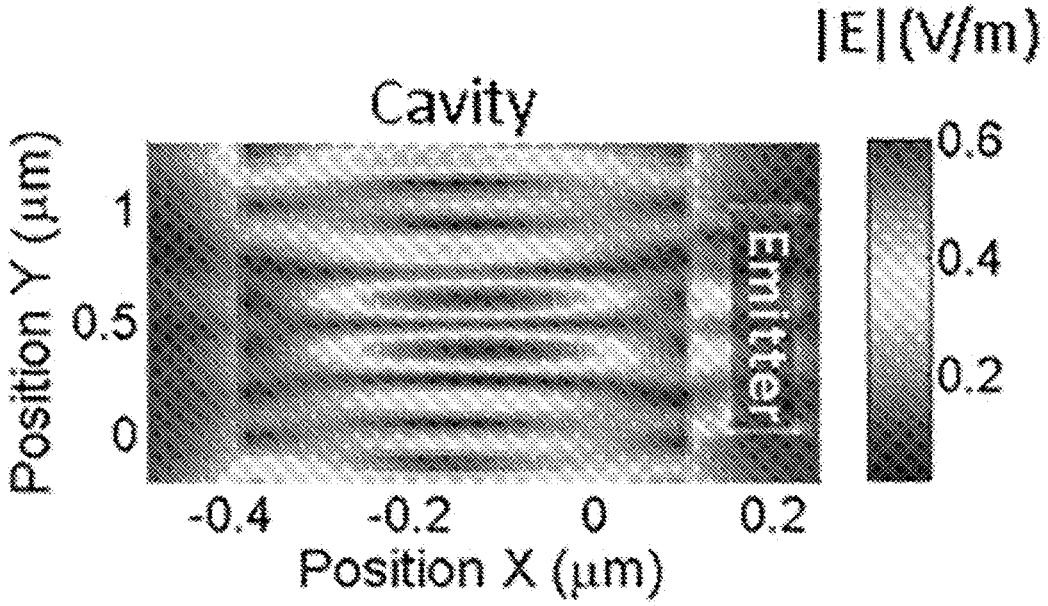
Figure 6E:
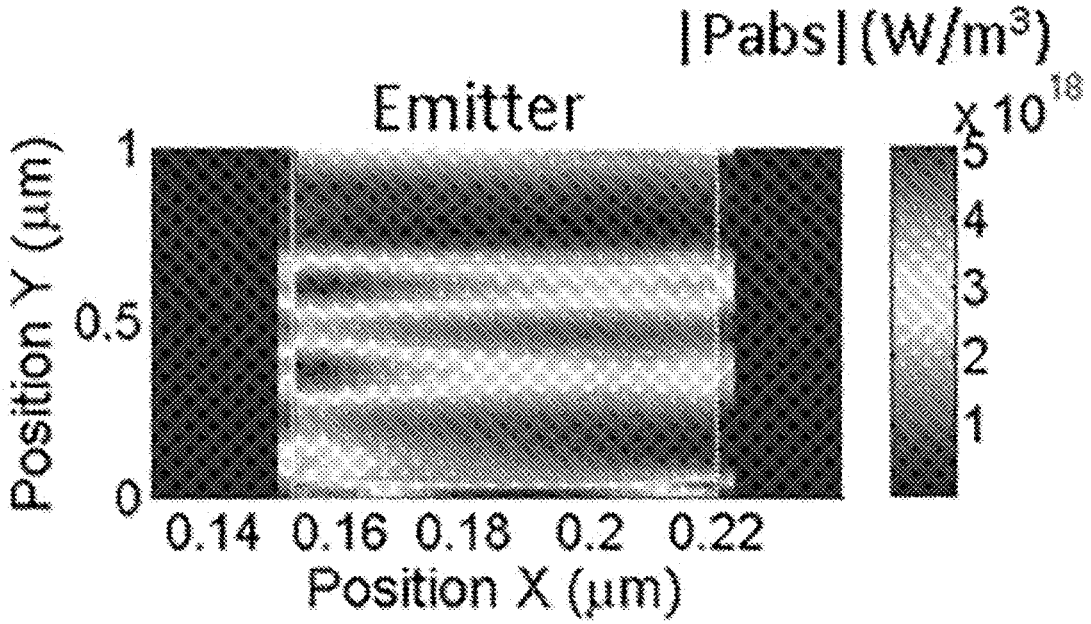

While the simple analytical approach set forth above offers much insight into the general design constraints, a detailed numerical simulation is necessary to quantify the performance of the proposed devices. Here, a 3D FDTD Maxwell equation solver was used to find the optical. absorption spectrum in the emitter as a function of both position and time. The optical absorption results from the FDTD solver are then used as inputs for a 3D thermal transport simulation, enabling us to ascertain (1) the steady state relationship between optical power injected into the cavity and emitter temperature, and (2) the transient thermal (cooling) response of the emitter. The simulation structure, as shown in FIG. 3(A), has two Bragg mirrors placed at the two ends of a 3 μm silicon waveguide to form an optical cavity. The details and characteristics of the mirrors are shown in FIG. 3D. Silicon/$LaB_6$ emitter of 1 μm length, 70 nm width, and 140 nm thickness is placed with edge-to-edge separation of 50 nm from the cavity. The cavity width and height are set to 500 and 220 nm, respectively. FIGS. 6C and 6D show cross section and top view of the E field profiles of the cavity and emitter. Also, FIG. 6E is the optical absorption profile on the emitter obtained from the simulation. In particular, two important features are observed: first, the presence of the evanescent coupling to the emitter modifies the optical mode, as shown by the nonuniformity of the mode in FIG. 6D, illustrating the need for the full simulations to obtain accurate solutions. Second, it can be seen that coherent light causes nonuniform absorption in the emitter itself, which must be considered when determining the heating profile of the emitter. FIG. 6A shows the emitter absorption spectrum. It can be seen that for this specific device, the peak absorption is ~25%, normalized to power injected into the cavity. As a reference, the absorption of a focused beam of light (free space) on the same emitter was also plotted. Here, the enhancement due to cavity is an order of magnitude and can be increased further through device optimization. The time dependence of the optical field in the cavity [FIG. 6B] is all shown, obtained by monitoring the field versus time at the middle of the optical cavity. Importantly, the photon lifetime in this configuration is observed to be less than 500 fs.

Figure 7A:
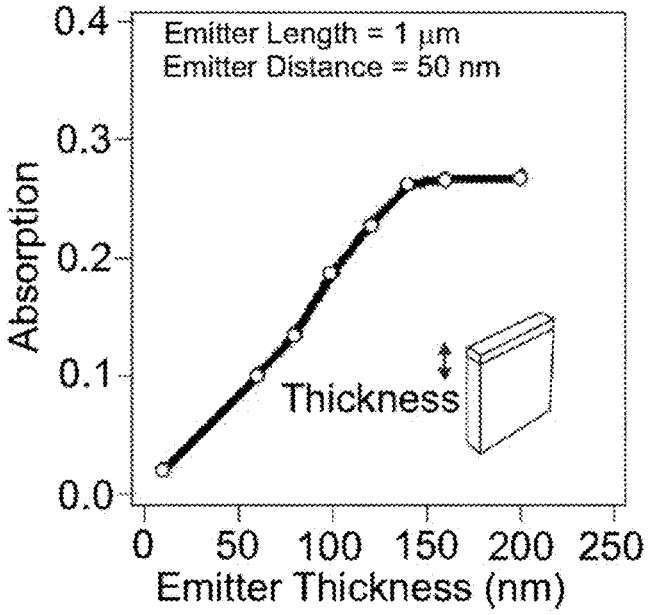
FIGS. 7A, 7B, 7C, and 7D: (A) Absorption vs. $LaB_6$ emitter thickness, illustrating effect of changing the single pass absorption, $A_S$, while keeping cavity properties constant. (B) Absorption vs. cavity-emitter distance, illustrating the decay of the cavity evanescent mode. (C) Absorption vs. emitter length and (D) cavity mirror reflectivity.
Figure 7B:
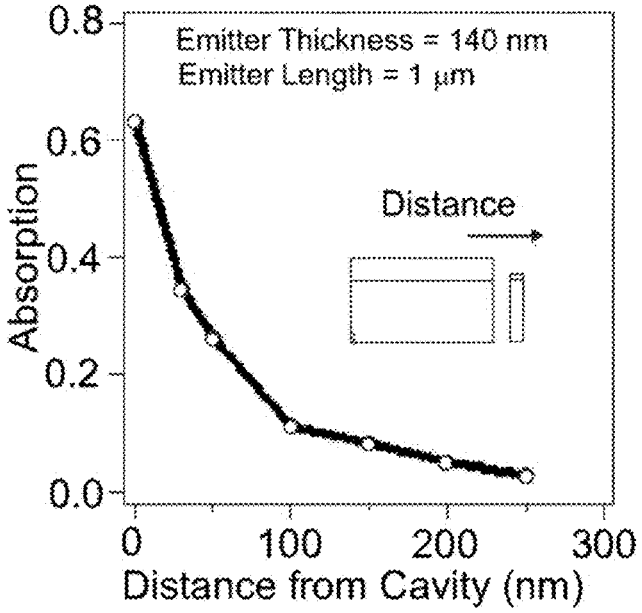
Figure 7C:
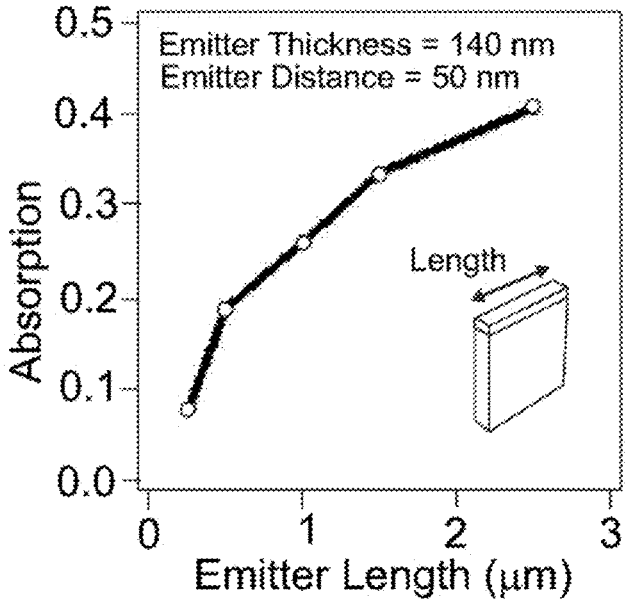
Figure 7D:
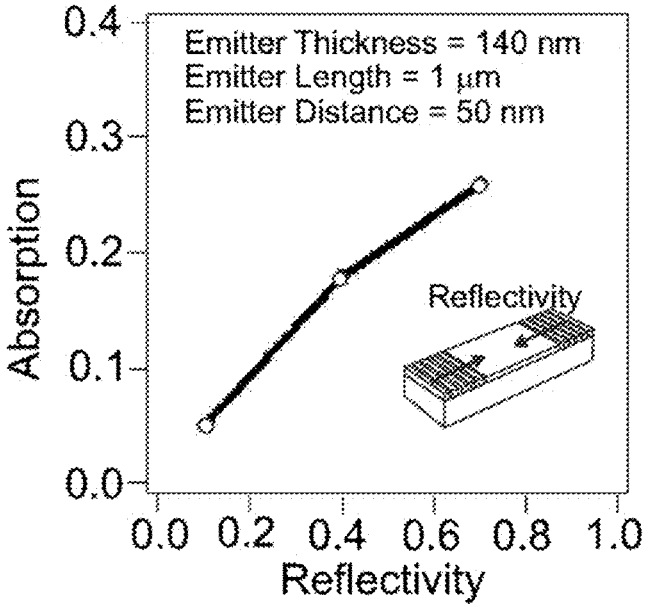

To determine the sensitivity of the performance to physical device parameters, OCTETs is simulated while varying emitter thickness, T, emitter-cavity distance, d, emitter length, L, and Bragg mirror reflectivity, Rb. Each of the emitter parameters explored essentially changes the single pass absorption of the emitter, $A_S$. First, the effect of increasing emitter thickness was explored as illustrated in FIG. 7A. Quantitatively, the absorption increases until T~150 nm and then saturates. This occurs due to the increasing overlap between the emitter and the cavity mode with increasing thickness, corresponding to an increase in $A_S$ as emitter thickness increases. The shape of the mode is visible in FIG. 6C, essentially showing that the mode does not exist evenly across the height of the cavity, with the bulk of the mode concentrated in the center, matching well with the observed thickness versus absorption trend. The dependence on cavity-emitter distance [FIG. 7B] demonstrates a reduction in absorption roughly following the expected exponential dependence of the evanescent coupling. Importantly, the absorption peak reaches above 60% at zero emitter-cavity distance, corresponding to the emitter touching the cavity. The absorption versus emitter length curve is shown in FIG. 7C. The single pass absorption $A_S$ should increase linearly with the length, which causes the overall absorption to take on a shape as shown in FIG. 5A for the Rb=0.7 case. Finally, the effect of tuning the cavity properties was explored by adjusting the mirror reflectivity, with the results shown in FIG. 5A. This is achieved by tuning the Bragg reflector design. In the regime of reflectivities explored here, the relation between total absorption and reflectivity is roughly linear. Importantly, through the simulation, it is observed that the simple equations are in good overall agreement with the trends obtained through detailed modeling, suggesting that they may be used to develop general OCTET designs, with computationally expensive detailed simulations used only to fine-tune the performance.

Figure 8A:
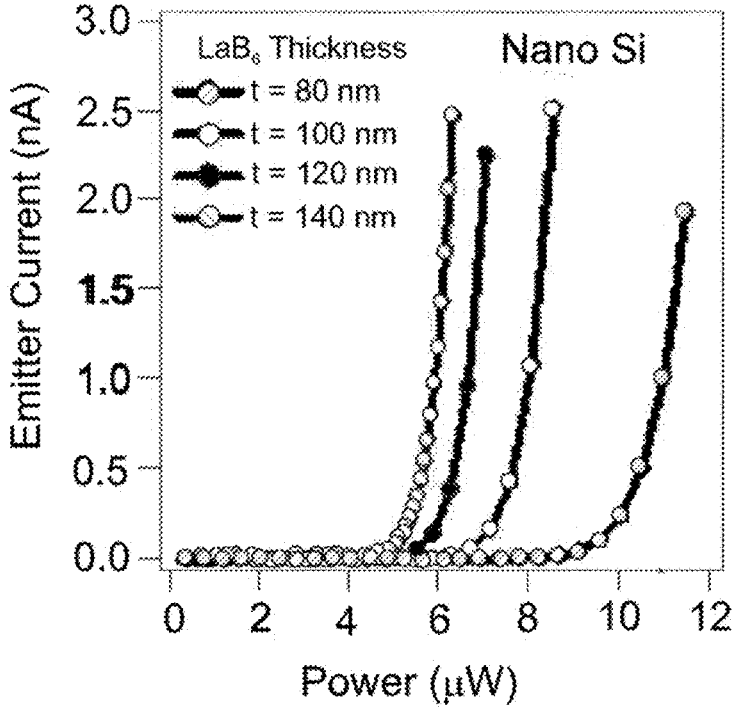
FIGS. 8A, 8B, 8C, 8D, 8E, and 8F: (A) Single emitter current vs. optical power injected into the cavity for nanostructured, low-thermal conductivity Si. Microwatts of optical power enable heating of tip by >1500 K. (B) Single emitter current vs. optical power injected into the cavity for bulk-Si thermal conductivity emitters. (C) Injected optical power required to achieve $LaB_6$ temperature of 2000K as a function of $LaB_6$ thickness. Both Si thermal conductivity and $LaB_6$-substrate distance ($L_{Fin}$) are varied here. (D) Transient thermal and current response for an 80 nm thick $LaB_6$ emitter. (E) Optical pulse energy required to heat emitter by 1000 K as a function of $LaB_6$ emitter thickness. (F) Full-width half-maximum of the thermal and current responses as a function of emitter thickness. Illustrates the tradeoff between efficiency and speed for fixed cavity properties.
Figure 8B:
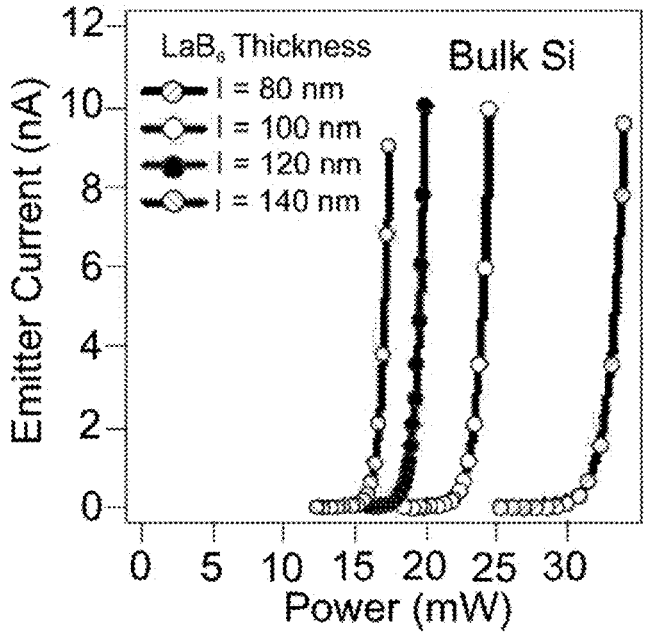
Figure 8C:
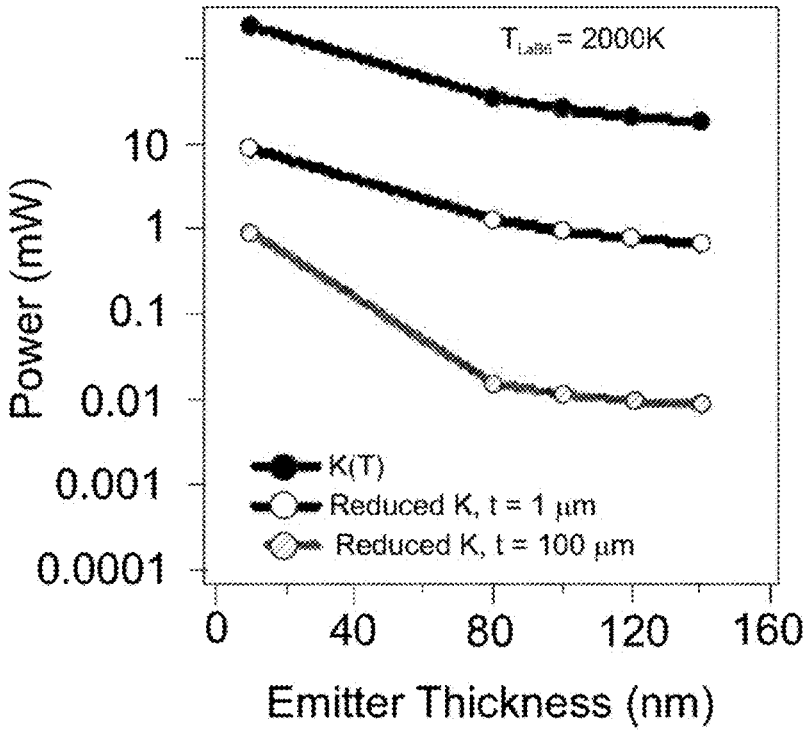
Figure 9:
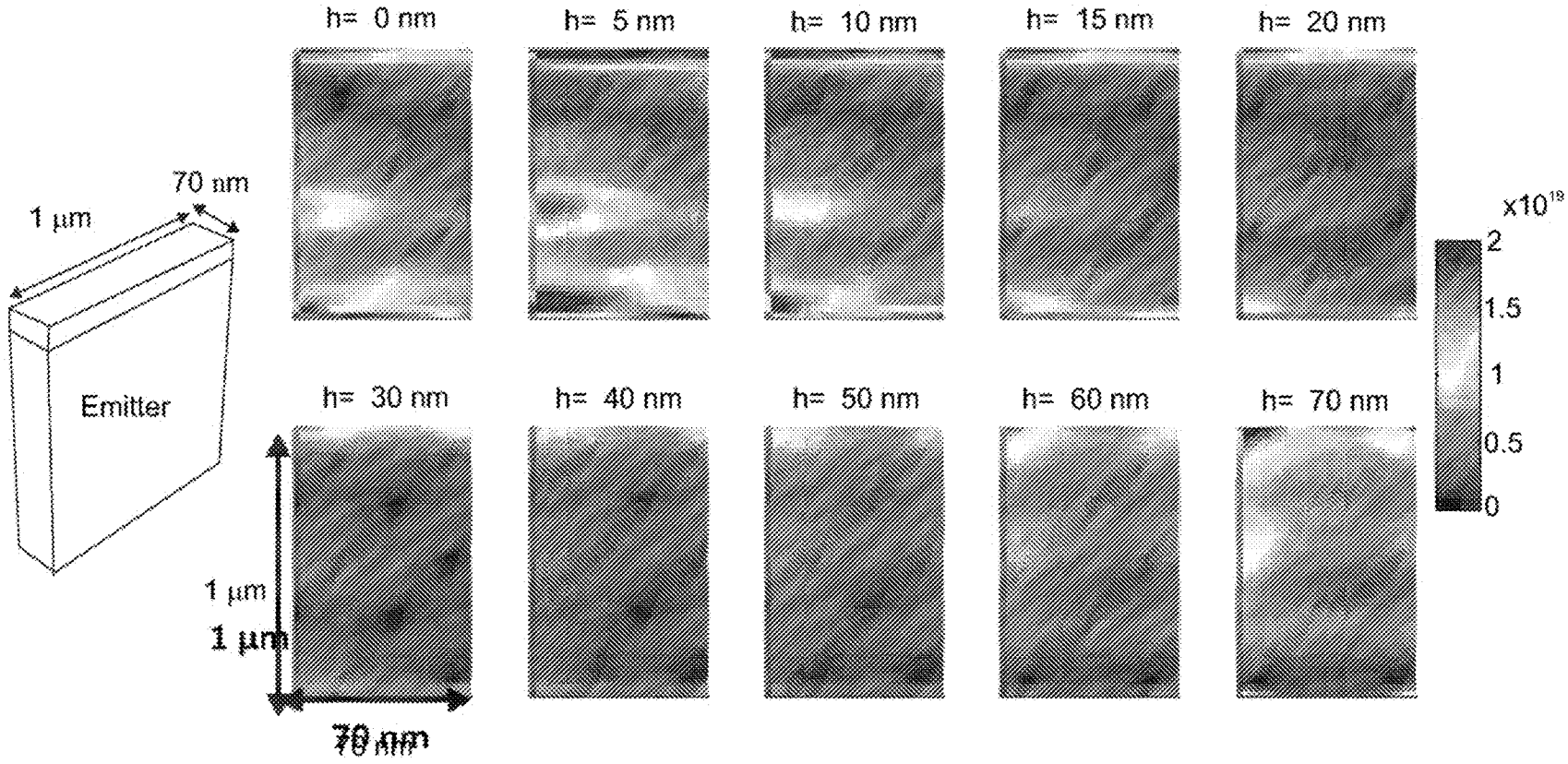
FIG. 9: Variation of optical absorption profile across height of the thermionic emitter.
Figure 10A:
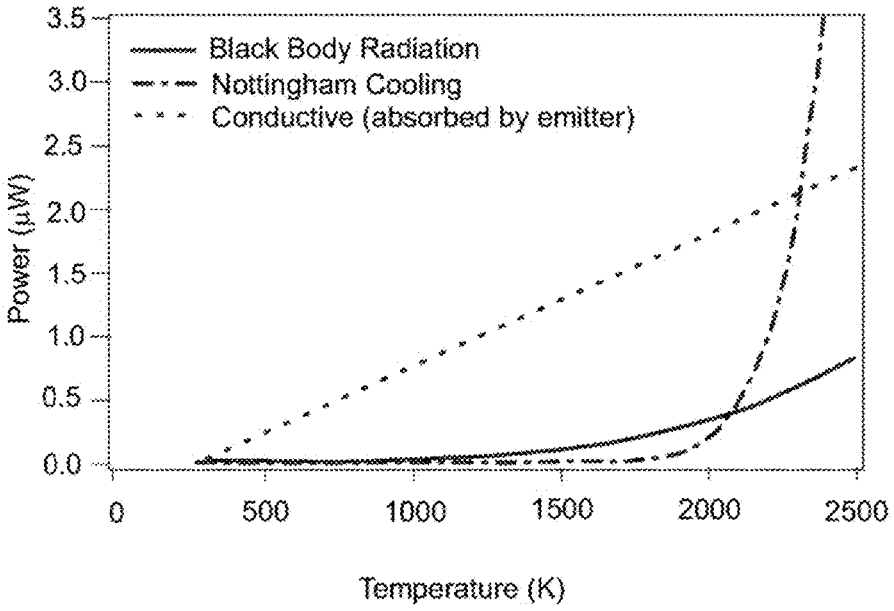
FIGS. 10A, B, and C: (A) Comparison between various power loss mechanisms. (B, C) Temperature distribution along emitter and silicon fin depth. The bottom side of the silicon fin set to constant room temperature and all other walls are thermally isolated.
Figure 10B:
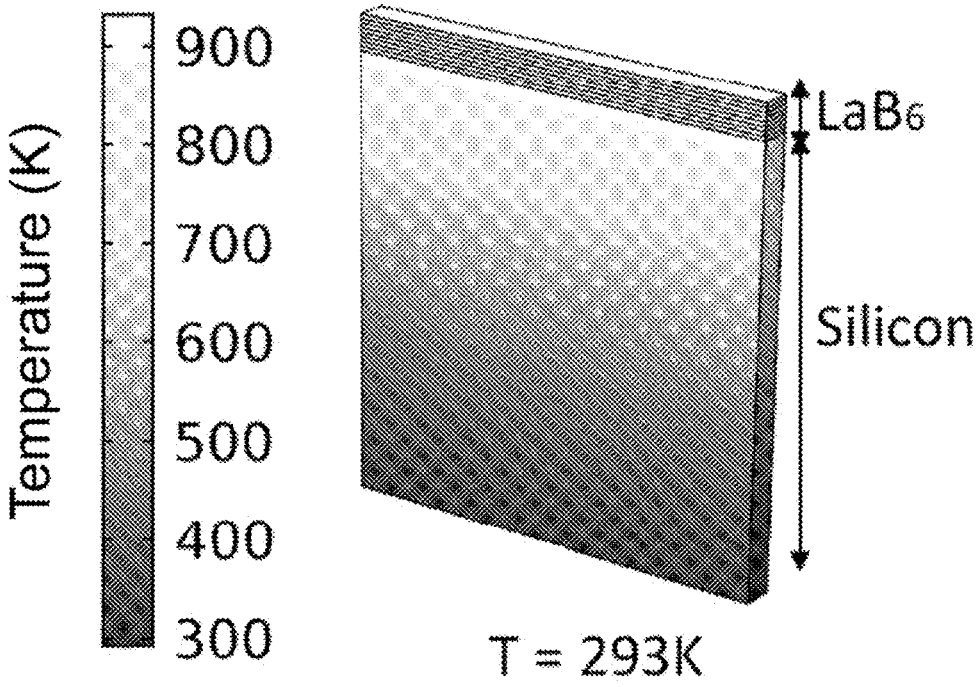
Figure 10C:
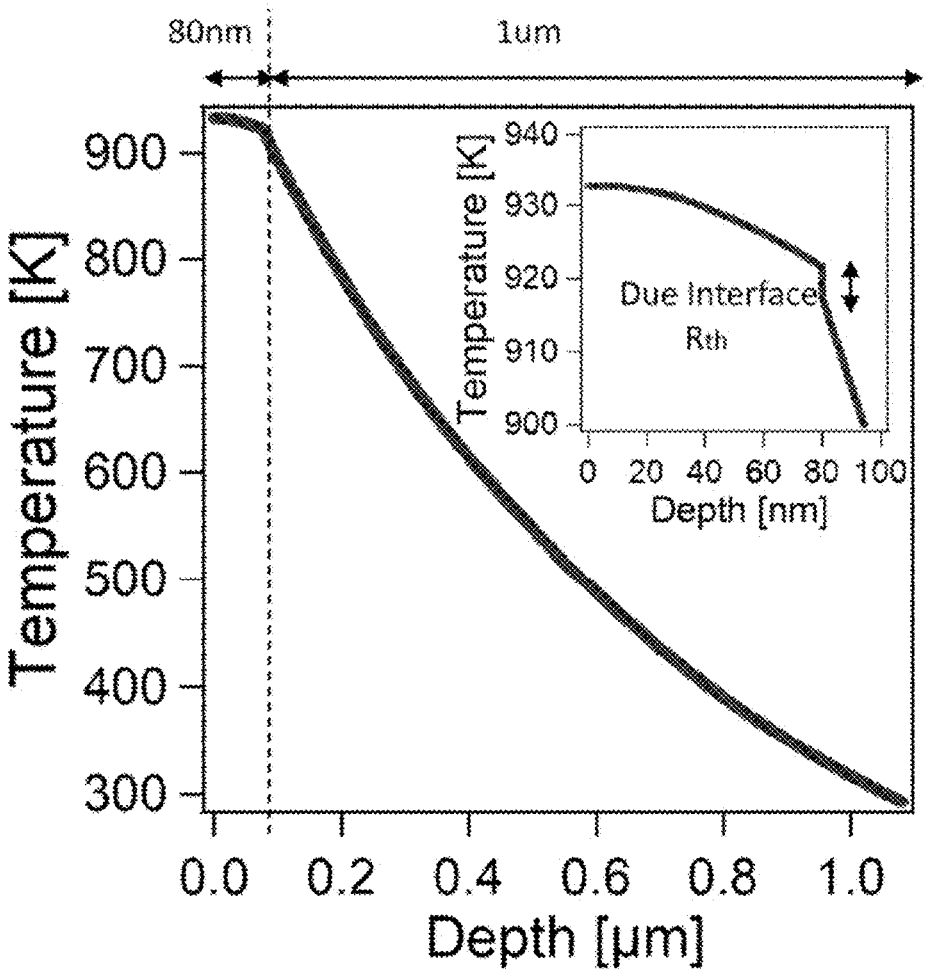

After obtaining the optical behavior, the effect of the emitter design on the thermal response was simulated via 3D thermal simulations using COMSOL. The heat input to the emitter was extracted from the optical simulation and imported into the thermal simulation, details of the absorption profiles are shown in FIG. 9. To accurately model the thermal properties of the device, experimentally determined temperature dependent thermal conductivity and heat capacity values for silicon as well as the interfacial thermal resistance between $LaB_6$ and silicon were utilized. The power reported here takes into consideration conductive thermal losses, as well as blackbody radiation, and cooling due to the Nottingham effect. The power loss for each mechanism has been separately plotted for T<2500K and shown in FIG. 10. The steady state thermal results are plotted for three cases: (1) fin length L=1 μm with bulk Si temperature dependent thermal conductivity, (2) fin length L=1 μm with nanostructured Si reduced thermal conductivity of 1.5 W/m K, and (3) fin length L=100 μm with $k_{Si}$=1.5 W/mK. The Richardson-Dushman equation was sued for calculating the steady state current considering all emitting surfaces after simulating the temperature distribution of the emitter and silicon fin device. In FIG. 8A, the emitter current is plotted as a function of optical power injected into the cavity. The reduction in powers needed for thicker $LaB_6$ is due to the improved absorption efficiency for the thicker devices explored here. Critically, it was shown that a significant ΔT ~1700K can be achieved with ~10 μW levels of injected optical power, or ~5.9 nW/K, enabled by the targeted optical absorption in OCTETs. FIG. 8B plots emitter current versus injected power for bulk silicon which has greater thermal conductivity and is suitable for fast modulation applications. In FIG. 8C, the required steady state power for different emitter thickness is plotted, and as expected, thicker emitters are highly efficient due to the larger optical absorption.

Figure 8D:
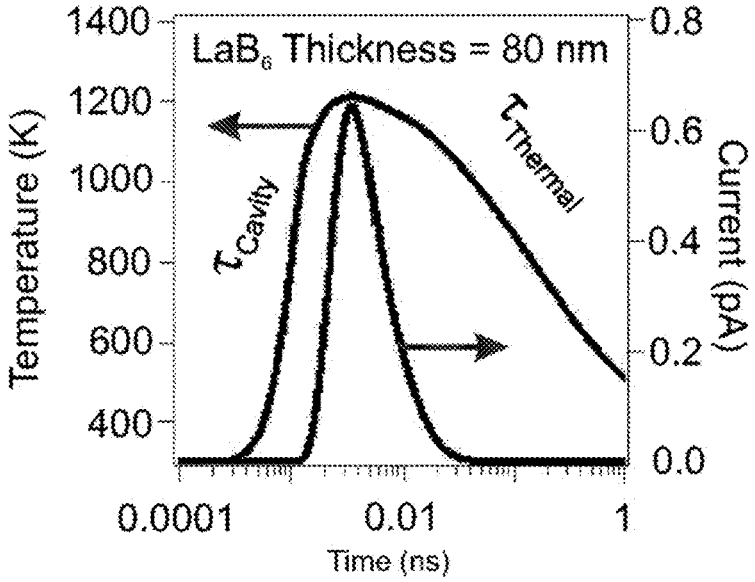
Figure 8E:
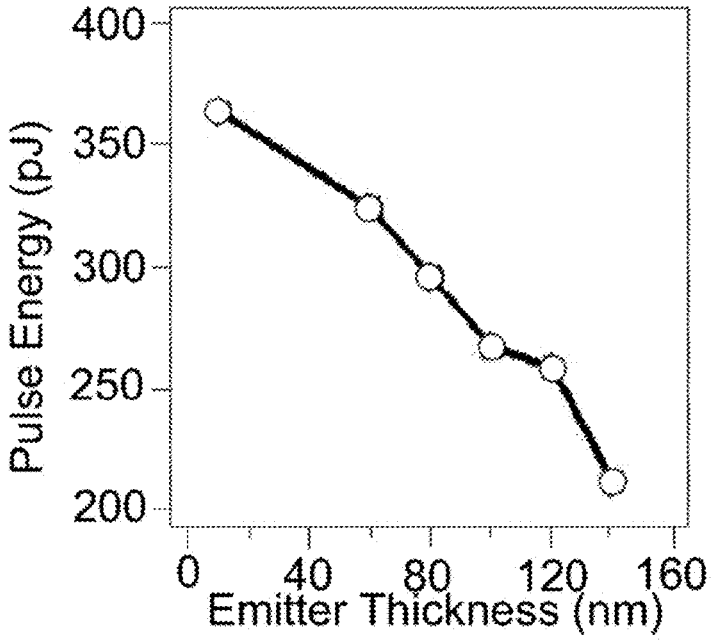
Figure 8F:
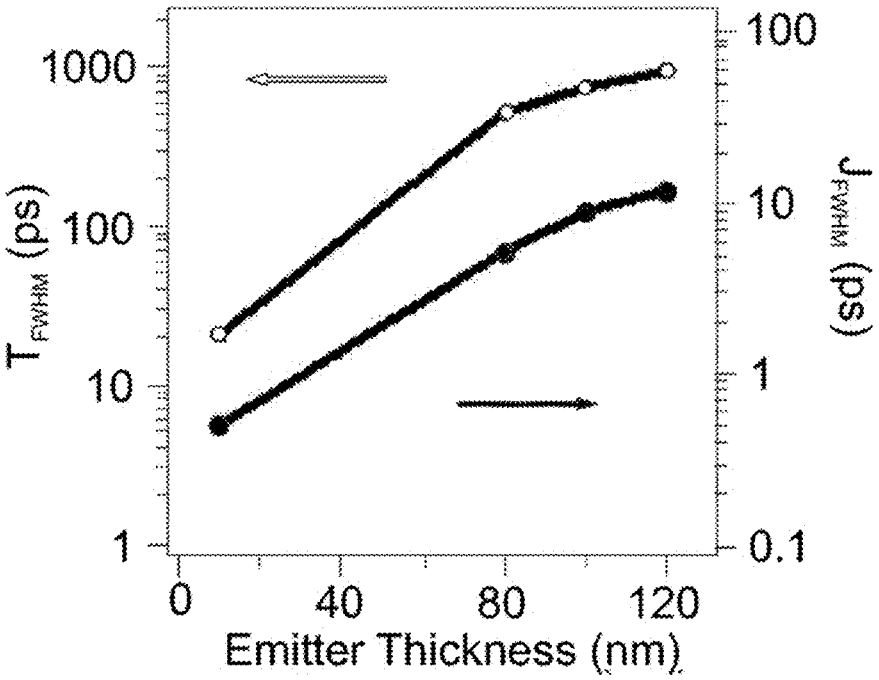

Next, the transient thermal response of these devices was studied. In the proposed device, 3 μm cavity and 1 μm $LaB_6$ emitter 50 nm from the cavity, the transient absorption results show that optical absorption from a single pulse occurs in about 1 ps, allowing us to assume that the electrons and phonons are at the same temperature. After heating, the emitter cools due to the Si substrate, which is assumed to be a heat sink at 300 K. FIG. 8D shows both the temperature and current profiles of a single emitter with a $LaB_6$ thickness of 80 nm. It is observed that the current response is significantly faster than the thermal response, as expected from the R-D equation. Here, the results for heating to 1200K (the peak temperature is 1214 K) are plotted, but the general behavior is similar for higher temperatures as well. FIG. 8E plots the required input optical pulse energy to heat the LaB6 emitters to a temperature of around 1200K as a function of thickness. The reduction in pulse energy with thickness is due to the improved optical absorption. It is noted that for accurate charge emission calculation when pulse absorption occurs significantly in the subpicosecond regime, multiphoton emission will need to be considered using the generalized Fowler-Dubridge theory. Finally, FIG. 8F plots the full width half maximum of both the temperature-time and the current-time as a function of $LaB_6$ thickness. Importantly, it is observed that that for the smallest $LaB_6$ thicknesses explored here, temperature-time FWHMs of ~0 ps are possible, and current time-FWHMs of <1 ps are possible. Potentially enabling both ultrafast thermionic guns as well as on-chip single electron sources.

Summary and Conclusions

In conclusion, a device platform that enables efficient and ultrafast optical modulation of thermionic emitters by coupling an on-chip heterostructured thermionic emitter with an optical cavity is explored. First, the critical device parameters are identified and used to develop simple equations that elucidated the steady-state and transient properties of these devices. Next, device performance was carefully evaluated through full 3D optical and thermal simulations using accurate geometries and materials parameters. The full simulation results also enabled validation of the simple analytical relations describing device performance. Importantly, it was found that through proper device design, steady-state tip heating of >1700K could be achieved with less than ~10 μW of injected optical power or ~5.9 nW/K, which could potentially be reduced through further optimization. By changing the properties of the emitter, ultrafast thermionic current responses <10 ps and thermal transient responses <1 ns are shown to be possible with this platform. While only thermionic emission was explored here, the general approach of coupling optical cavities to electron emission micro-/nanostructures is a potentially rich field, enabling engineering of photoemission, multiphoton and multicolor emission processes, as well as mixed mode electron emission processes. Additionally, by designing the emission structures to support surface plasmon or surface plasmon polariton modes, these approaches could enable efficient generation and emission of nonequilibrium electrons. Finally, by enabling simple on-chip integration, the approach outlined here opens up the space for ultrafast, optically modulated electron beams in microscale devices.

Figure 11A:
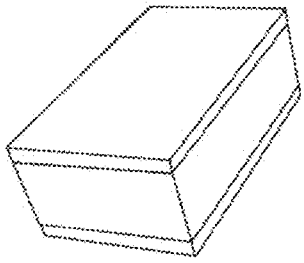
FIGS. 11A, 11B, 11C, 11D, 11E, 11F, 11G, and 11H: Fabrication process, (A) Hard mask deposition, (B) V-groove patterning, (C) V-groove opening window, (D) V-groove formation via KOH anisotropic etching of substrate silicon, (E) Waveguide formation, (F) contact deposition, (G) graphene transfer on waveguide and annealing, (H) fiber alignment and optical coupling
Figure 11B:
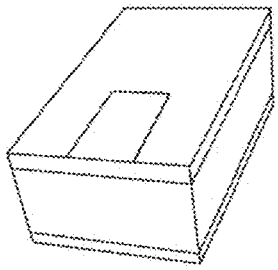
Figure 11C:
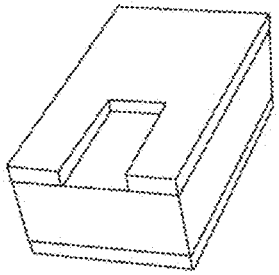
Figure 11D:
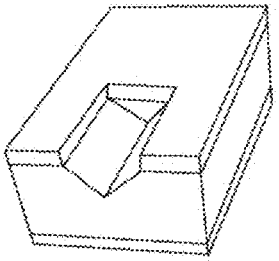
Figure 11E:
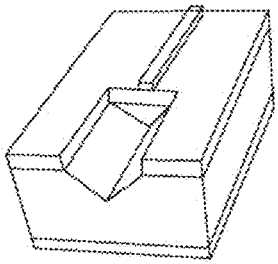
Figure 11F:
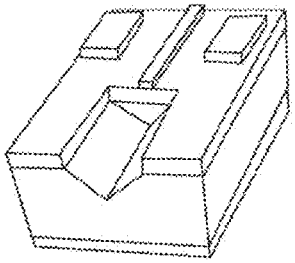
Figure 11G:
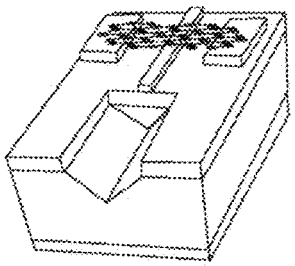
Figure 11H:
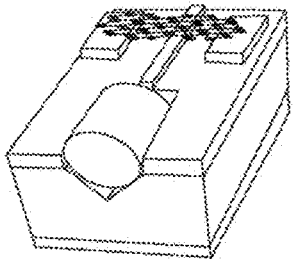
Figure 12A:
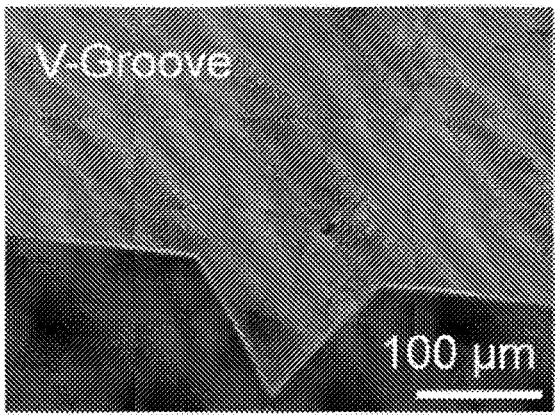
FIGS. 12A, 12B, and 12C: SEM images of the fabricated device.
Figure 12B:
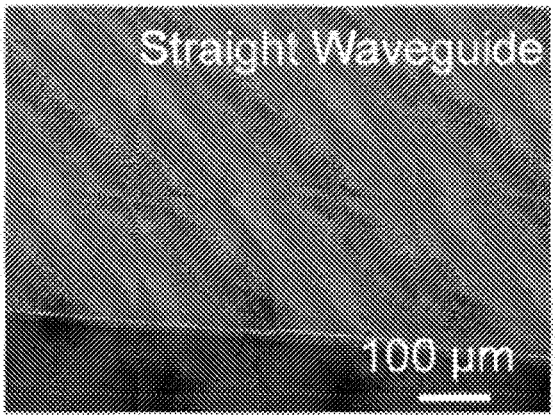
Figure 12C:
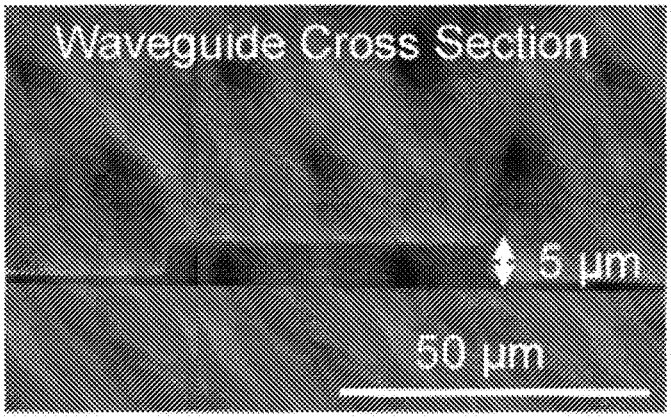

II. Integrated Optical Waveguide Assisted Electron Emission from Graphene Emitter Device Fabrication:

Schematic of the proposed integrated waveguide assisted electron emission device is shown in FIG. 4. This emitter consists of graphene layer as an electron emitter transferred directly above the optical waveguide with two gold contacts for conducting emission current to external measurement equipment and optical fiber to couple the laser to optical waveguide for transferring underneath the electron emitter layer. Fabrication process of this device is summarized in FIG. 11. A<1 0 0> oriented P-type lightly doped (1-10 Ω·cm) silicon substrate was used with a hard mask of $SiO_2$ (4 μm on back-2 μm on front) and $Si_3N_4$ (0.5 μm on back-12 nm on front) as a protection layer (FIG. 11A) against potassium hydroxide (KOH) etching of the substrate being deposited. Photoresist AZ5214 was spin coated with 500 rpm for 5 s and 3000 rpm for 60 s and baked at 100° C. for 1 min. Prior to exposure, V-groove pattern should be aligned parallel to the primary flat of the <1 0 0> substrate. This step is necessary for anisotropic etching of the silicon via KOH. After the exposure with a dose of 80 mJ/cm$^2$ and developing process (FIG. 11B), substrate was hard baked at 150° C. for 30 min before wet etching of the hard mask layer to open the V-groove window. Buffered oxide etchant (BOE) 7:1 was used and the window above V-groove (FIG. 11C) opened. In next step, 30% KOH solution at 75° C. was used to make the V-groove structure (FIG. 11D) that is used for coupling the light from optical fiber to waveguide. The SEM image of the V-groove is shown in FIG. 12A. The opening of the V-groove is 240 μm. After V-groove fabrication, $SiO_2$ (1 μm on front side) and thick $Si_3N_4$ (5 μm on front side) as the clad and core of the optical waveguide respectively are deposited. For waveguide patterning, photoresist AZ4620 is uses which allows photoresist as thick as 10-12 μm which is necessary for long $Si_3N_4$ RIE process. This photoresist was spin coated with 500 rpm for 15 s and 2000 rpm for 25 s and baked at 100° C. for 2 min. After 2 hours of resting time for this photoresist, the waveguide opening was aligned with the V-groove and expose with a dose of 450 mJ/cm$^2$ followed by 4 min developing. After this step, $Si_3N_4$ RIE process performed to etch the $Si_3N_4$ and form the waveguide. For this process, $CF_4$ and $O_2$ with the ratio of 3:1 with 100 W of power under 50 mTorr pressure was used to etch the $Si_3N_4$. The SEM image of the top and cross section view of the final waveguide is shown in FIG. 12B-12C. The waveguide has a width of 50 μm and height of 5 μm as a multimode waveguide. After waveguide fabrication, Ti/Au (5/100 nm) was evaporated on both sides of the waveguide as an electrical contact as shown in FIG. 11F. After metal evaporation, the CVD grown graphene was transferred on top of optical waveguide using wet transfer technique (FIG. 11G). After transfer, annealing performed using rapid thermal annealing (RTA) to remove the PMMA residue and assure an appropriate adhesion of the graphene sheet to optical waveguide for optimal evanescent optical absorption. A fiber coupled tunable CW laser source at 445 nm with special fiber provided for this specific wavelength with metallic shield to reduce the optical loss was used. This fiber has diameter of 200 μm and last step was to align this fiber inside the V-groove for optical coupling (FIG. 11H). After alignment, the fiber was fixed using epoxy and cured it using heat lamp. Graphene on optical waveguide is characterized using a Raman imaging (the result is shown in FIG. 12D).

Figure 13A:
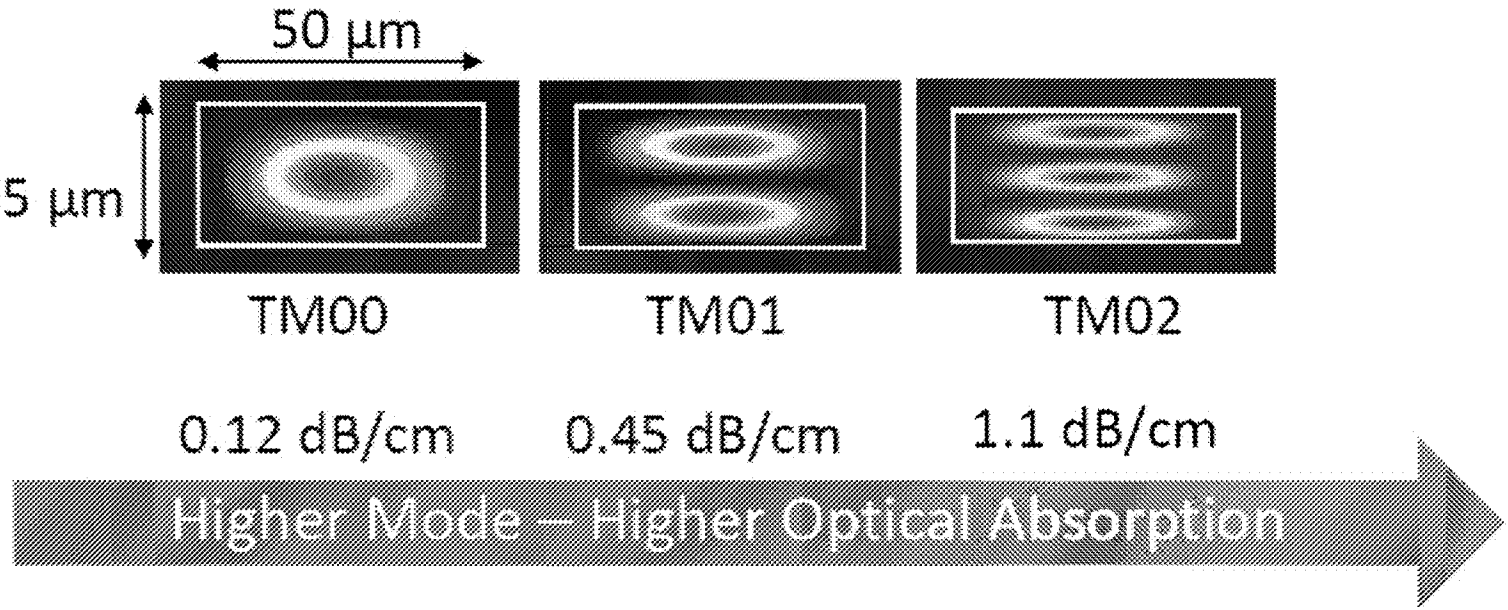
FIGS. 13A, 13B, 13C, and 13D: (A) Graphene absorption of various optical mode, (B) optical mode excited inside waveguide coupled from optical fiber, (C) Measurement results on graphene absorption above waveguide, (D) Graphene optical absorption.
Figure 13B:
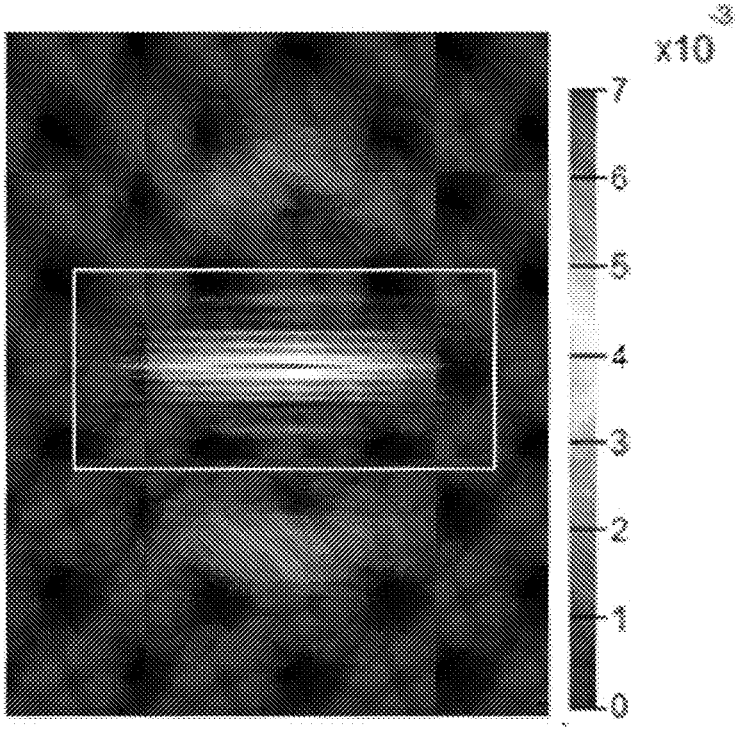
Figure 13C:
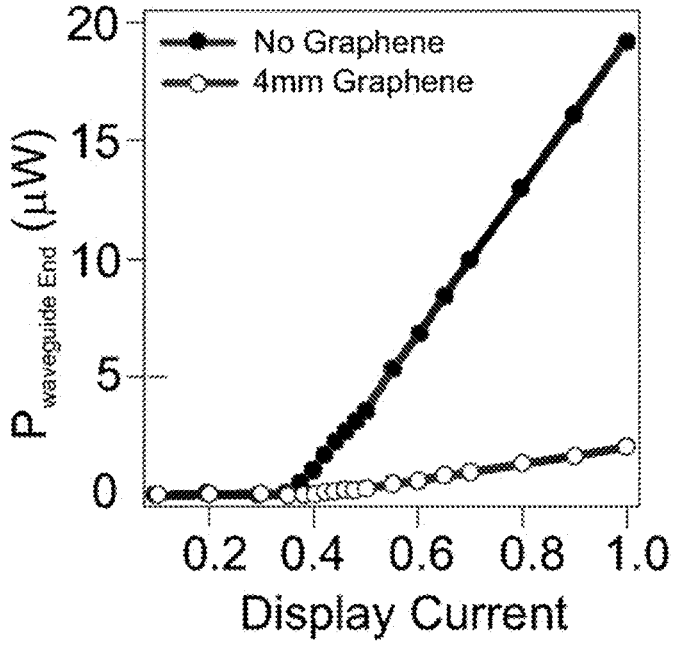
Figure 13D:
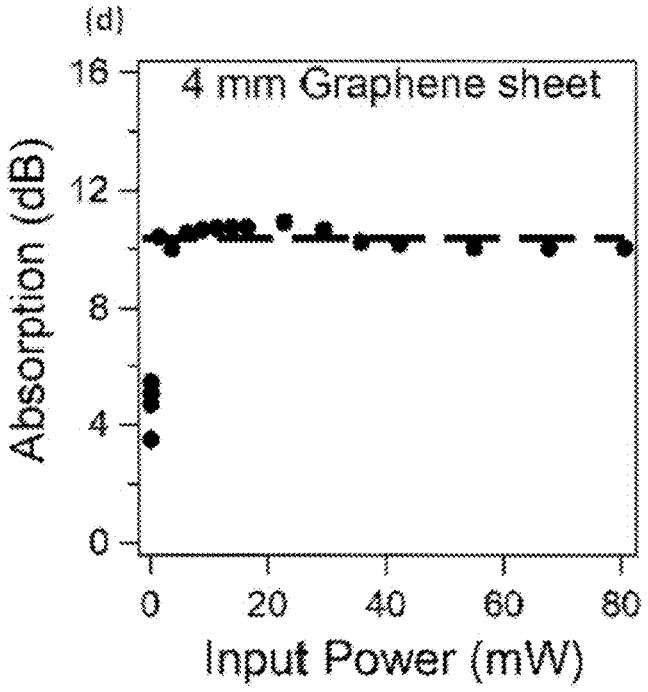
Figure 14A:
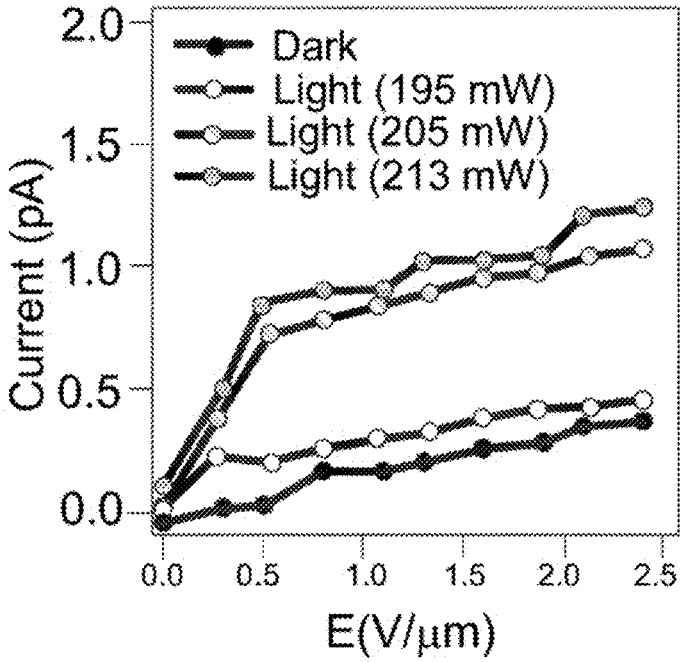
Figure 14B:
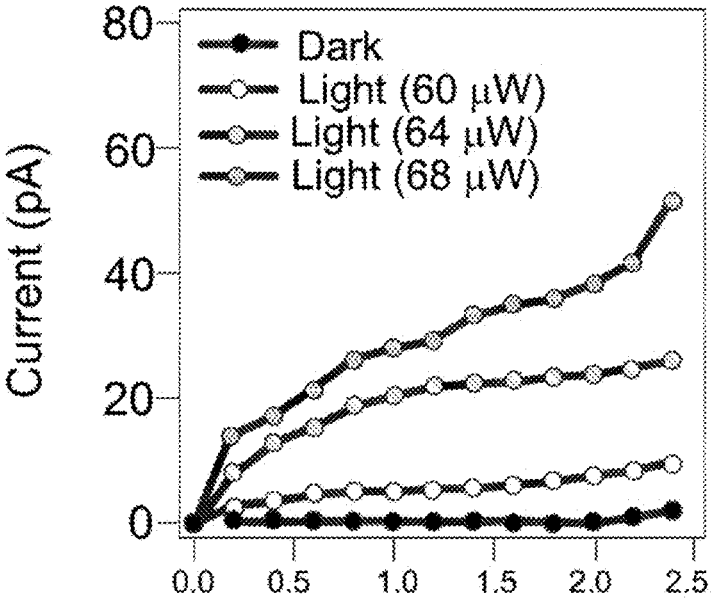
Figure 15A:
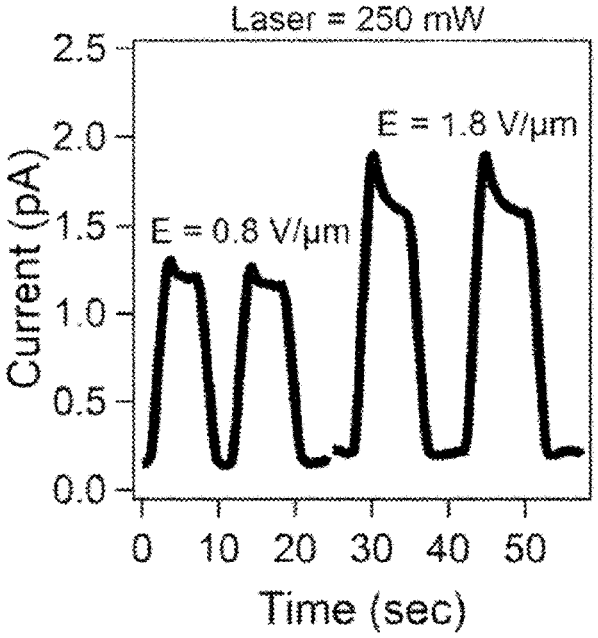
FIGS. 15A and 15B: (A) Free Space Illuminated Emission Device, (B) Integrated waveguide assisted Emission Device.
Figure 15B:
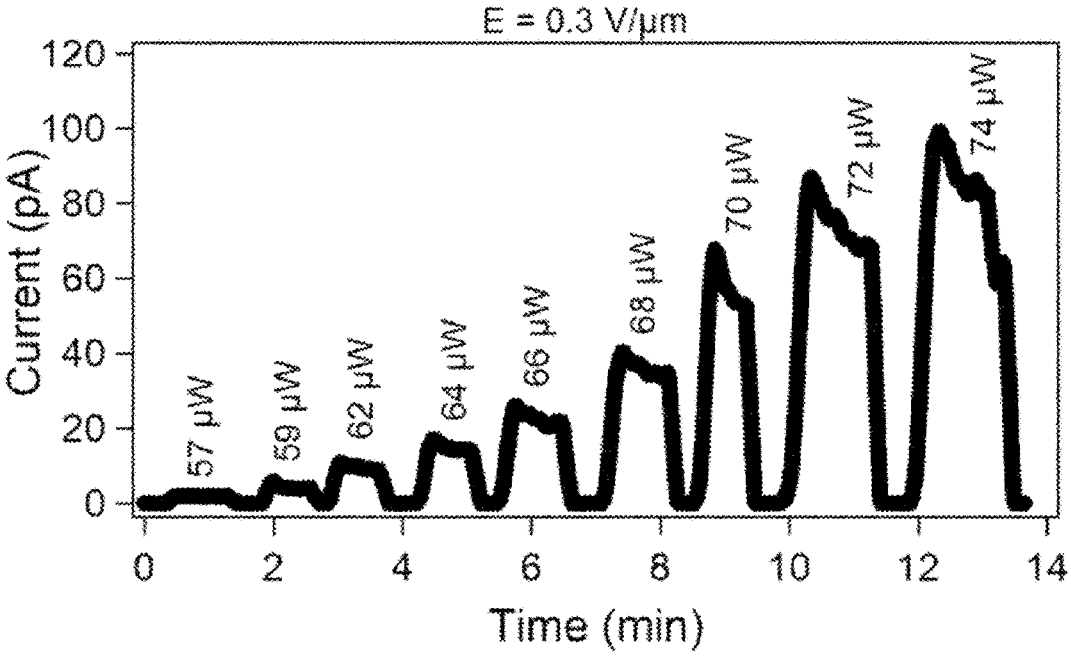

Graphene Absorption Measurement & Simulation:

The graphene layer absorbs photons from optical waveguide. The optical absorption was characterized via measuring the output from waveguide before and after transferring 4 mm graphene layer above waveguide. FIG. 13A shows the optical power at the end of waveguide with and without graphene layer. The result indicates 90% of optical absorption in graphene layer. Using FDTD solver, the optical absorption of the graphene from various modes inside the optical waveguide and the coupled mode from fiber to $Si_3N_4$ waveguide was investigated. FIG. 13B shows the absorption of fundamental and higher order mode through graphene placed over $Si_3N_4$ waveguide. It can be seen graphene layer absorption increases significantly for higher order mode. This is because higher order modes have mode peaks at the proximity of the graphene layer and for evanescent optical coupling, the distance of these peaks from graphene layer plays critical role. FIG. 13C shows the mode coupled in to $Si_3N_4$ waveguide indicates higher order mode coupling to waveguide. It should be noted that waveguide with height smaller than 1 μm will have peak closer to graphene layer at their fundamental and lower order modes. A 5 μm thick waveguide was selected for easier optical coupling from fiber to waveguide.

Experimental Set Up and Results:

The fiber coupled laser source transport the optical power in to vacuum chamber using optical feedthrough for multimode fiber with 400 μm diameter for wavelength range of 190 nm to 1100 nm with minimum optical loss at 850 nm. As such, the power after optical feedthrough was measured to know the exact power illuminated at the input of the optical waveguide. The power at the end of optical waveguide after coupling was also characterized. From these measurements, it was observed that input power of 250 mW at waveguide input (end of fiber) ends up to 80 μW of optical power at the end of optical waveguide. This optical loss is partially due to the surface roughness at the wall of the waveguides, however the major source of optical loss is geometrical mismatch between the large fiber (diameter of 200 μm) and smaller optical waveguide (height of 5 μm).

The field emission characteristics for emission device were measured at room temperature under a vacuum of 10-7 Torr. Photo-current detection was carried out using a Keysight B2985A electrometer connected via triaxial cable directly to our cathode for low noise measurement. First, the I-E curves for dark and laser assisted emission from a graphene layer on heavily doped silicon substrate were characterized. This graphene sheet was illuminated from side (free space illuminated device). It was observed that up to 1 pA of photon assisted current using this conventional free space illumination method. Then, the I-E curve for dark and photon assisted emission from graphene layer on optical waveguide referred to as "waveguide assisted electron emission device" was measured. For this device, up to 40 pA of current using laser was measured. Note the input power for the three curves of free space illuminated device and integrated device is the same. However, it was shown that the waveguide output power for integrated device as a measure of required power if emitter layer absorbs photons evanescently from waveguide. In addition, it should be noted that photon assisted electron emission can be detected at relatively small E-field. For integrated devices, electron emission close to 17 pA at 0.2 V/μm was detected.

The transient response under different optical power was also measured. Here, like previous plot, it is noted that the coupled power for integrated device. For free space illumination, photon assisted current signal at 250 mW is shown for two different E-field. Even at higher E-field photon assisted current doesn't exceed 2 pA for free space illuminated device. For integrated emission device, a larger current was observed as the input optical power increased. Note, this measurement performed at relatively small E-field, only 0.3 V/μm. The current versus laser power for integrated device was also measured. Photo-current curve can be fitted with polynomial 2nd order that indicates two photons contribution in the process. This matches with theoretical expectation given graphene work function of 4.5 eV and a laser source photon energy of 2.78 eV. As such two-photons contribution is necessary for photo emission over the barrier.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

Each of the following references is incorporated herein by reference in its entirety:

Goldstein, J.; Newbury, D. E.; Echlin, P.; Joy, D. C.; Romig Jr, A. D.; Lyman, C. E.; Fiori, C.; Lifshin, E., Springer Science & Business Media: 2012.

Reimer, L., Springer: Vol. 36, 2013.

Vieu, C.; Carcenac, F.; Pepin, A.; Chen, Y.; Mejias, M.; Lebib, A.; Manin-Ferlazzo, L.; Couraud, L.; Launois, H., Applied Surface Science, 164 (1), 111-117, 2000.

Goebel, D. M.; Katz, I., John Wiley & Sons: Vol. 1, 2008.

Benford, J.; Swegle, J. A.; Schamiloglu, E., High power microwaves. CRC Press: 2007.

Gold, S. H.; Nusinovich, G. S., Review of Scientific instruments 1997, 68 (11), 3945-3974.

Barker, R. J.; Luhmann, N. C.; Booske, J. H.; Nusinovich, G. S., by Robert J. Barker (Editor), Neville C. Luhmann (Editor), John H. Booske (Editor), Gregory S. Nusinovich, pp. 872. ISBN 0-471-68372-8. Wiley-VCH, April 2005. 2005, 1.

Brau, C. A., Free-electron lasers. 1990.

Wang, Q.; Setlur, A.; Lauerhaas, J.; Dai, J.; Seelig, E.; Chang, R., Applied Physics Letters, 72 (22), 2912, 1998.

Kartikeyan, M. V.; Borie, E.; Thumm, M., Springer Science & Business Media: 2013.

C. J. Glassbrenner and Glen A. Slack, Physical Review, Vol 134, No 4A, 1964.

Haitao Wang.; Yibin Xu.; Masato Shimono.; Yoshihisa Tanaka and Masayoshi Yamazaki, The Japan Institute of Metals and Materials, Vol. 48, No. 9, pp. 2349-2352, 2007.

Mahmoud Bakr, R. Kinjo, Y. W. Choi, M. Omer, K. Yoshida, S. Ueda, M. Takasaki, K. Ishida, N. Kimura, H. Zen, T. Sonobe, T. Kii, K. Masuda and H. Ohgaki, Korean Physical Society, Vol. 59, No. 5, pp. 3273-3279, November 2011.

Ling Liu and Xi Chen, Applied Physics, vol. 107, 2010.

R. E. Honig and J. R. Woolston, Appl. Phys. Letters 2, 138(1963).

D. Lichtman and J. F. Ready, Phys. Rev. Letters 10, 342(1963).

C. M. Verber and A. H. Adelman, Appl. Phys. Letters 2, 220 (1963).

F. Giori, L. A. McKenzie, and E. J. McKinney, Appl. Phys. Letters 3, 25 (1963).

J. F. Ready, Phys. Rev. 137, A620 (1965); J. Appl. Phys. 36, 462 (1965).

W. L. Knecht, Appl. Phys. Letters 6, 99 (1965).

H. Sonnenberg, H. Heffner, and W. Spicer, Appl. Phys. Letters 5, 95 (1964).

M. C. Teich, J. M. Schroeer, and G. J. Wolga, Phys. Rev. Letters 13, 611 (1964).

E. M. Logothetis and P. L. Hartman, Phys. Rev. Letters Vol 187, 2 (1969).

J. H. Bechtel, t W. Lee Smith, ~and N. Bloembergen, Phys. Rev B VOL 15, 10 (1977).

Peter Hommelhoff et al, PRL 96, 077401 (2006).

Brau, C. A., *Free-electron lasers*. JSTOR: 1990; Vol. 22.

Booske, John H., et al. "Vacuum electronic high-power terahertz sources." *IEEE Transactions on Terahertz Science and Technology* 1.1 (2011): 54-75.

Wayne E. King et al, Journal of Applied Physics 97, 111101 (2005).

F. Le Pimpeca et al, Appl. Phys. A 112, 647 (2013).

W. E. Spicer, Phys. Rev. 112, 114 (1958).

Huan Li et al, Appl. Phys. Lett. 101, 111110 (2012).

S. J. Koester and M. Li, "Waveguide-Coupled Graphene Optoelectronics," IEEE J. Sel. Top. Quantum Electron. 20(1), 6000211 (2014). 14

F. Rezaeifar and R. Kapadia, J. Vac. Sci. Technol., B 34, 041228 (2016).

What is claimed is:

1. A photonic electron emission device comprising:

an emitter comprising a component selected from the group consisting of a metal, a semimetal, a semiconductor having a bandgap that is less than about 3.5 eV;

a photonic energy conduit evanescently coupled to the emitter wherein the emitter emits an electron emission current induced by photonic energy received from the photonic energy conduit; and an anode that is positively biased with respect to the emitter, the anode directing electrons emitted from the emitter.

2. The photonic electron emission device of claim 1 wherein the photonic energy conduit includes a waveguide and an electromagnetic radiation source coupled to the waveguide.

3. The photonic electron emission device of claim 1 wherein the photonic energy conduit includes an optical cavity and an electromagnetic radiation source coupled to a waveguide.

4. The photonic electron emission device of claim 3 wherein the optical cavity is configured to provide an optical field in the optical cavity, and wherein the optical field interacts with the emitter for modulating the emitter.

5. The photonic electron emission device of claim 1 wherein the emitter is a thermionic emitter.

6. The photonic electron emission device of claim 1 wherein the emitter is a heterostructured thermionic emitter.

7. The photonic electron emission device of claim 1 wherein the emitter includes a protrusion having a top surface and an emission active material disposed adjacent to the top surface of the protrusion.

8. The photonic electron emission device of claim 1 wherein the emitter includes a silicon fin having a top surface and a $LaB_6$ layer disposed adjacent to the top surface of the silicon fin.

9. The photonic electron emission device of claim 8 wherein the $LaB_6$ layer provides a photon absorber and the silicon fin provides a thermal and electrical contact.

10. The photonic electron emission device of claim 1 wherein the photonic electron emission device is fabricated on-chip as an integrated design.

11. The photonic electron emission device of claim 1 wherein optical energy conduit includes a microfabricated optical cavity fabricated on a silicon wafer.

12. The photonic electron emission device of claim 1 wherein the photonic energy conduit includes a Fabry-Perot resonator.

13. The photonic electron emission device of claim 1 wherein the photonic energy conduit includes a ring resonator.

14. The photonic electron emission device of claim 1, wherein the emitter includes a small bandgap material or a metallic thermionic emitter, either of which being deposited on a wider bandgap material.

15. The photonic electron emission device of claim 1, wherein the emitter includes a graphene layer.

16. The photonic electron emission device of claim 15 wherein the emitter contacts the photonic energy conduit.

17. The photonic electron emission device of claim 15 wherein the graphene layer is positioned at a distance from about 0 to 100 nm from the photonic energy conduit.

18. The photonic electron emission device of claim 15 wherein the graphene layer has a thickness form about 0.1 mm to about 10 mm.

19. The photonic electron emission device of claim 15 wherein the photonic energy conduit includes a waveguide or an optical cavity.

20. The photonic electron emission device of claim 15 wherein the electron emission current is formed by photoemission, photo-assisted field emission, thermionic emission, or a combination thereof.

21. An array of photonic electron emission devices positioned on a substrate, the array of photonic electron emission devices including the photonic electron emission device of claim 1.

* * * * *